US009937731B2

(12) United States Patent
Mathis et al.

(10) Patent No.: US 9,937,731 B2
(45) Date of Patent: Apr. 10, 2018

(54) AUTOMATED SYSTEM AND METHOD FOR PRINTING IMAGES ON A SURFACE

(71) Applicant: The Boeing Company, Chicago, IL (US)

(72) Inventors: Dennis R. Mathis, Charleston, SC (US); Philip L. Freeman, Summerville, SC (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/244,967

(22) Filed: Aug. 23, 2016

(65) Prior Publication Data

US 2016/0355026 A1 Dec. 8, 2016

Related U.S. Application Data

(62) Division of application No. 14/726,387, filed on May 29, 2015, now Pat. No. 9,452,616.

(51) Int. Cl.

| | |
|---|---|
| ***B41J 3/407*** | (2006.01) |
| ***B41J 2/21*** | (2006.01) |
| ***B41J 2/01*** | (2006.01) |

(52) U.S. Cl.

CPC ..... *B41J 3/4073* (2013.01); *B41J 2/01* (2013.01); *B41J 2/2132* (2013.01)

(58) Field of Classification Search

CPC ..... B41J 3/4073; B41J 2/01; B41J 2/2132

See application file for complete search history.

(56) References Cited

U.S. PATENT DOCUMENTS

| | | | | |
|---|---|---|---|---|
| 5,931,098 | A | 8/1999 | Bates | |
| 6,508,531 | B1 | 1/2003 | Gargir | |
| 7,350,890 | B2 | 4/2008 | Baird et al. | |
| 8,088,450 | B2 | 1/2012 | Swanberg et al. | |
| 2009/0111701 | A1 | 4/2009 | Ahn | |
| 2012/0092403 | A1* | 4/2012 | Profaca | B41J 2/155 347/14 |

(Continued)

FOREIGN PATENT DOCUMENTS

| | | |
|---|---|---|
| EP | 0455371 | 11/1991 |
| EP | 2208541 | 7/2010 |
| EP | 2839964 | 2/2015 |

OTHER PUBLICATIONS

European Search Report, EP16160553, dated Sep. 30, 2016.

(Continued)

*Primary Examiner* — Alessandro Amari
*Assistant Examiner* — Roger W Pisha, II

(57) ABSTRACT

A system for printing an image on a surface includes a robot, a printhead having a reference line printing mechanism, and a reference line sensor. The robot has at least one arm. The printhead is mounted to the arm and is movable by the arm over a surface along a rastering path while printing a new image slice on the surface. The reference line printing mechanism is configured to print a reference line on the surface when printing the new image slice. The reference line sensor is configured to sense the reference line of an existing image slice and transmit a signal to the robot causing the arm to adjust the printhead in a manner such that a side edge of the new image slice is aligned with the side edge of the existing image slice.

18 Claims, 16 Drawing Sheets

(56) References Cited

U.S. PATENT DOCUMENTS

| | | | | |
|---|---|---|---|---|
| 2013/0015292 | A1 | 1/2013 | Zielinski | |
| 2014/0139851 | A1* | 5/2014 | Mizes | B41J 29/393 358/1.9 |
| 2014/0063096 | A1 | 6/2014 | Pitz | |
| 2014/0214184 | A1 | 7/2014 | Freeman | |

OTHER PUBLICATIONS

Williams, "The Delta Parallel Robot: Kinematics Solutions", Internet Publication, www.ohio.edu/people/williar4/html/pdf/DeltaKin.pdf, Apr. 2015.

Wikipedia, "Delta Robot," <http://en.wikipedia.org/wiki/Delta_robot>, retrieved May 13, 2015.

Russian Office Action, 2016107611/12(012053), dated Sep. 13, 2017.

* cited by examiner

AUTOMATED SYSTEM AND METHOD FOR PRINTING IMAGES ON A SURFACE

CROSS-REFERENCE TO RELATED APPLICATIONS

The present application is a divisional application of and claims priority to pending U.S. application Ser. No. 14/726,387 filed on May 29, 2015, and entitled SYSTEM AND METHOD FOR PRINTING AN IMAGE ON A SURFACE, the entire contents of which is expressly incorporated by reference herein.

FIELD

The present disclosure relates generally to coating application systems and, more particularly, to an automated system and method of printing images on a surface using a robotic mechanism.

BACKGROUND

The painting of an aircraft is a relatively challenging and time-consuming process due to the wide range of dimensions, the unique geometry, and the large amount of surface area on an aircraft. For example, the wings protruding from the fuselage can interfere with the painting process. The height of the vertical tail above the horizontal tail can present challenges in accessing the exterior surfaces of the vertical tail. Adding to the time required to paint an aircraft are complex paint schemes that may be associated with an aircraft livery. In this regard, the standard livery of an airline may include images or designs with complex geometric shapes and color combinations and may include the name and logo of the airline which may be applied to different locations of the aircraft such as the fuselage, the vertical tail, and the engine nacelles.

Conventional methods of painting an aircraft require multiple steps of masking, painting, and demasking. For applying an aircraft livery with multiple colors, it may be necessary to perform the steps of masking, painting, and demasking for each color in the livery and which may add to the overall amount of time required to paint the aircraft. In addition, the aircraft livery must be applied in a precise manner to avoid gaps that may otherwise expose a typically-white undercoat which may detract from the overall appearance of the aircraft. Furthermore, the process of applying paint to the aircraft surfaces must be carried out with a high level of control to ensure an acceptable level of coating thickness to meet performance (e.g., weight) requirements.

As can be seen, there exists a need in the art for a system and method for painting an aircraft including applying complex and/or multi-colored images in a precise, cost-effective, and timely manner.

SUMMARY

The above-noted needs associated with aircraft painting are specifically addressed and alleviated by the present disclosure which provides a system for printing an image on a surface using a robot having at least one arm. A printhead may be mounted to the arm and may be movable by the arm over a surface along a rastering path while printing an image slice on the surface. The image slice may have opposing side edges. The printhead may be configured to print the image slice with an image gradient band along at least one of opposing side edges wherein an image intensity within the image gradient band decreases from an inner portion of the image gradient band toward the side edge.

Also disclosed is a system for printing an image comprising a robot having at least one arm and a printhead mounted to the arm. The printhead may be movable by the arm over a surface along a rastering path while printing a new image slice on the surface. The system may include a reference line printing mechanism configured to print a reference line on the surface when printing the new image slice. The system may include a reference line sensor configured to sense the reference line of an existing image slice and transmit a signal to the robot causing the arm to adjust the printhead such that a side edge of the new image slice is aligned with the side edge of the existing image slice.

In addition, disclosed is a method of printing an image on a surface. The method may include positioning an arm of a robot adjacent to a surface. The arm may have a printhead mounted to the arm. The method may further include moving, using the arm, the printhead over the surface along a rastering path while printing an image slice on the surface. In addition, the method may include printing an image gradient band along at least one side edge of the image slice when printing the image slice. The image gradient band may have an image intensity that decreases along a direction toward the side edge.

A further method of printing an image on a surface may include printing, using a printhead mounted to an arm of a robot, a new image slice on the surface while moving the printhead over the surface along a rastering path. The method may additionally include printing a reference line on the surface when printing the new image slice. The method may also include sensing, using a reference line sensor, the reference line of an existing image slice while printing the new image slice. Furthermore, the method may include adjusting the lateral position of the new image slice based on a sensed position of the reference line in a manner aligning a side edge of the new image slice with the side edge of the existing image slice.

The features, functions and advantages that have been discussed can be achieved independently in various embodiments of the present disclosure or may be combined in yet other embodiments, further details of which can be seen with reference to the following description and drawings below.

BRIEF DESCRIPTION OF THE DRAWINGS

These and other features of the present disclosure will become more apparent upon reference to the drawings wherein like numbers refer to like parts throughout and wherein.

DETAILED DESCRIPTION

Figure 1:
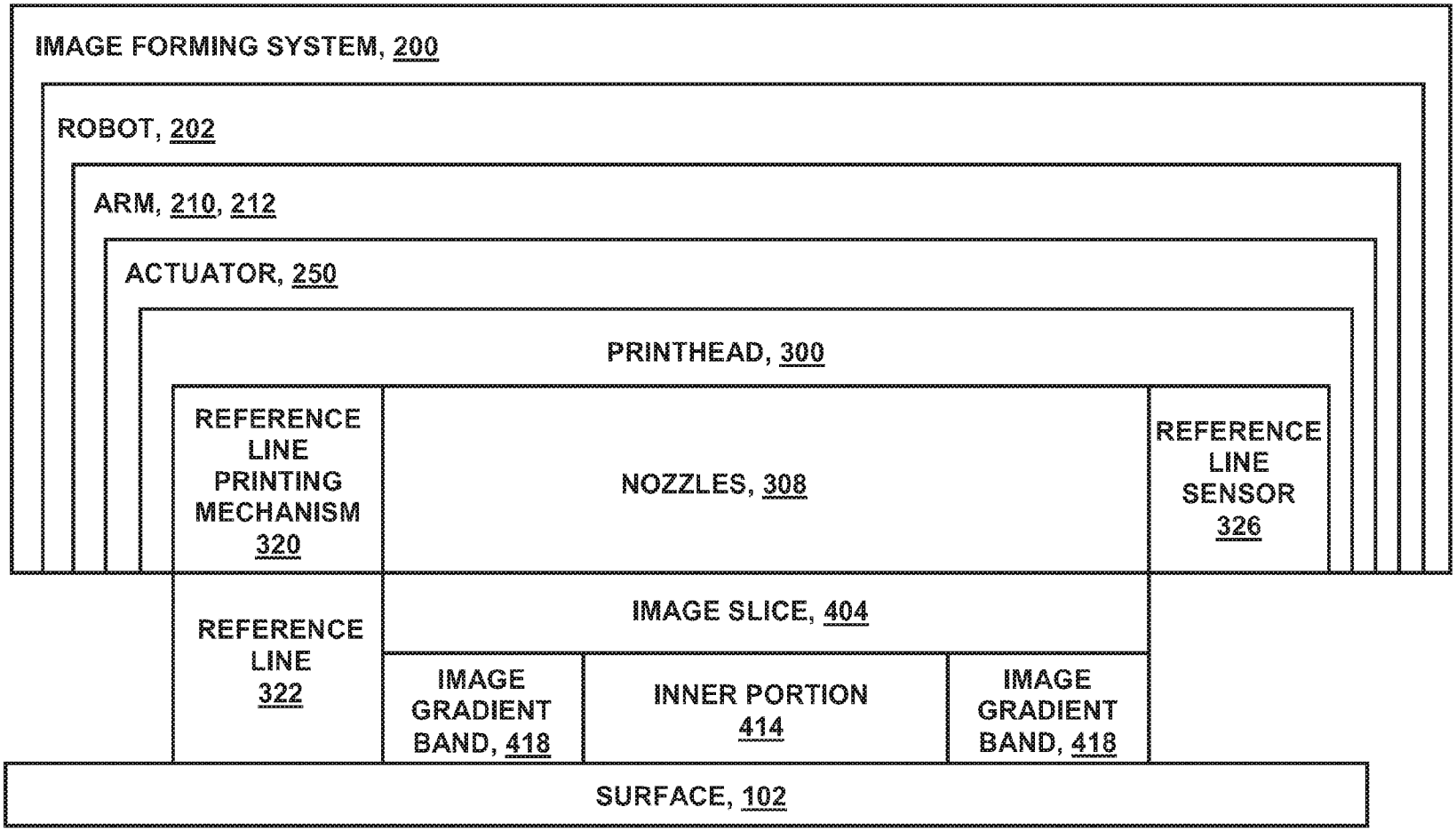
FIG. 1 is a block diagram of an example of an image forming system.

Referring now to the drawings wherein the showings are for purposes of illustrating various embodiments of the present disclosure, shown in FIG. 1 is a block diagram of an example of an image forming system 200 as may be implemented for robotically (e.g., automatically or semi-automatically) printing an image 400 (FIG. 2) on a surface 102. The system 200 may include a robot 202 (a robotic mechanism) and/or at least one arm (e.g., a first and second arm 210, 212). The printhead 300 may be mounted on an arm (e.g., the second arm 212). In some examples, the system 200 may include one or more high-bandwidth actuators 250 coupling the printhead 300 to the end 214 (FIG. 5) of the arm. As described below, such high-bandwidth actuators 250 may provide precise and rapid control over the position and orientation of the printhead 300 during printing of an image slice 404.

The printhead 300 may be configured as an inkjet printhead having a plurality of nozzles 308 or orifices for ejecting droplets 330 (FIG. 10) of ink, paint, or other fluids or colorants onto a surface 102 to form an image 400. The inkjet printhead 300 may be configured as a thermal inkjet printer, a piezoelectric printer, or a continuous printer. However, the printhead 300 may be provided in other configurations such as a dot matrix printer or other printer configurations capable of printing an image 400 on a surface 102.

Figure 6:
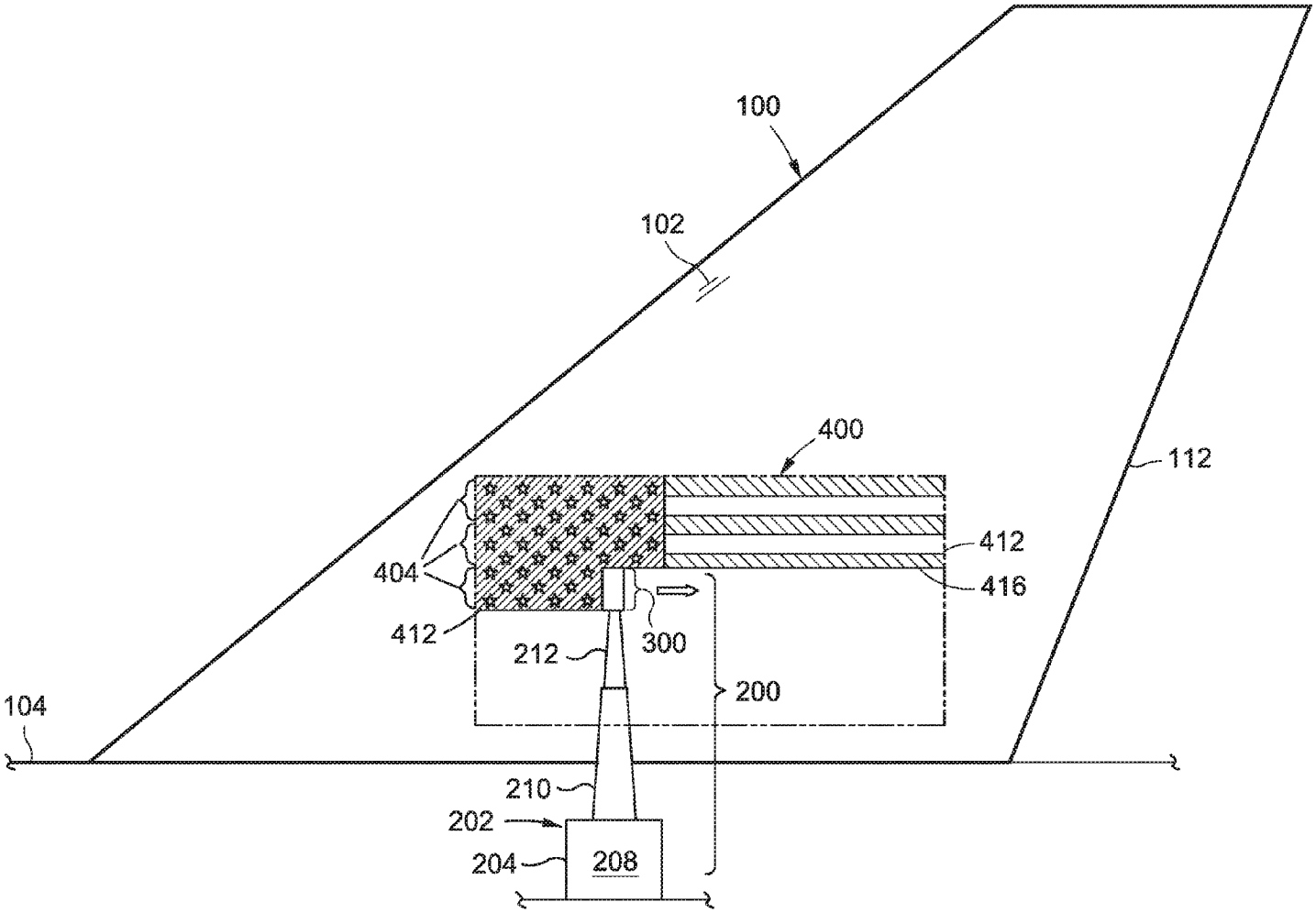
FIG. 6 is a side view of the image forming system taken along line 6 of FIG. 4 and illustrating the printhead printing an image on the vertical tail.
Figure 7:
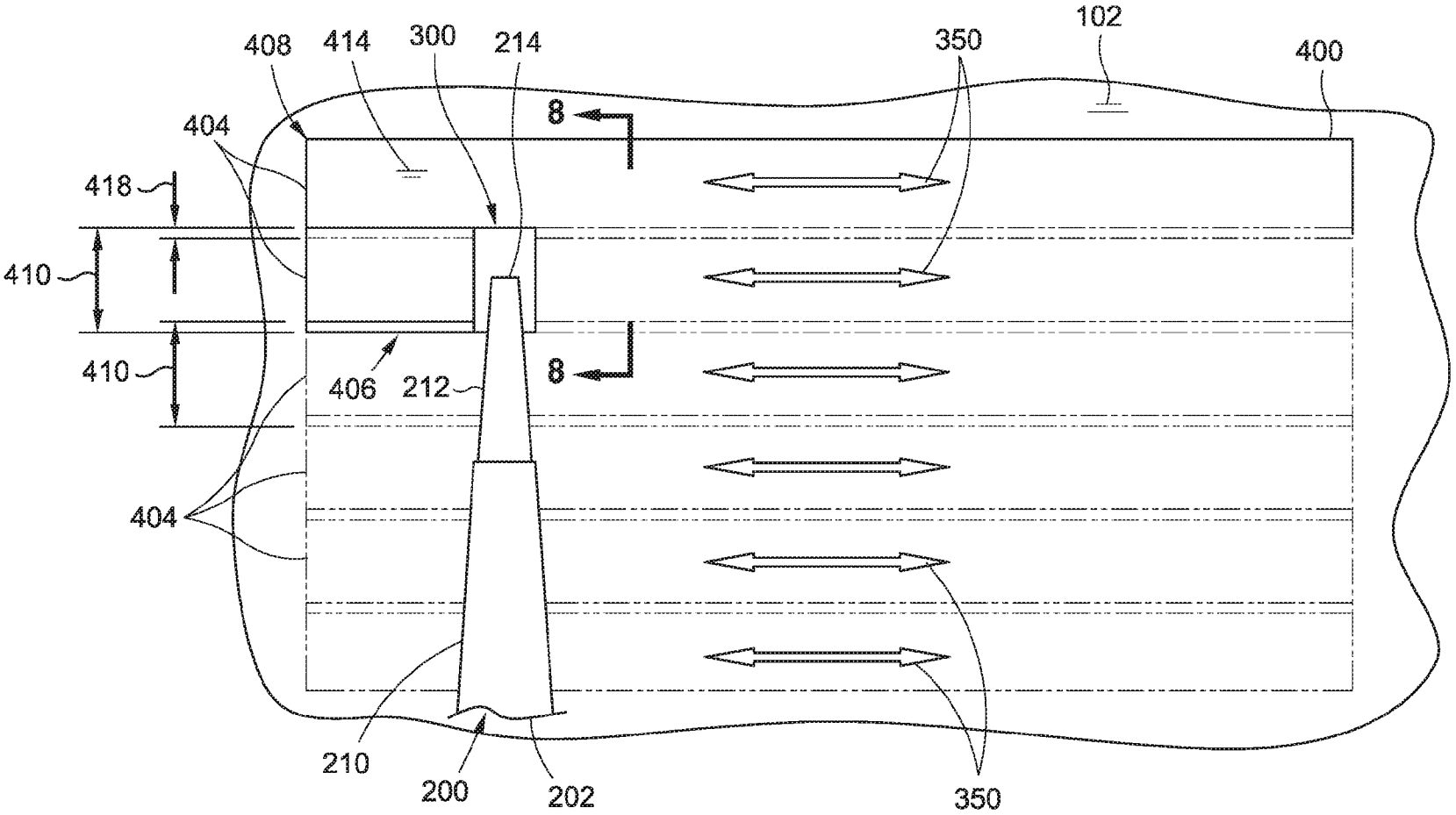
FIG. 7 is a plan view of an example of a printhead being moved along a rastering path to form an image slice having an image gradient band overlapping the image gradient band of an adjacent image slice.

The image forming system 200 may print image slices 404 on a surface 102 along a series of parallel rastering paths 350 (FIG. 7). The parallel image slices 404 may collectively form an image 400. In one example, the printhead 300 may print an image slice 404 in overlapping relation to an adjacent image slice 404. In this regard, the printhead 300 may be configured to print an image slice 404 with an image gradient band 418 along at least one side edge 416 (FIG. 6) of the image slice 404. The image gradient band 418 of one image slice 404 may overlap the image gradient band 418 of an adjacent image slice 404. The image intensity within an image gradient band 418 may decrease along the direction transverse to the direction of the rastering path 350. By overlapping the image gradient bands 418 of adjacent image slices 404, gaps in the image 400 may be prevented. In the present disclosure, the image intensity within overlapping image gradient bands 418 may result in a substantially uniform image gradient across the width of an image 400 such that the overlaps may be visually imperceptible. In one example, the image intensity within the overlapping image gradient bands 418 may be substantially equivalent to the image intensity within an inner portion 414 of each image slice 404.

In another example of the image forming system 200, the printhead 300 may include a reference line printing mechanism 320 that may print a reference line 322 during the printing of an image slice 404. For example, a reference line 322 may be printed along a side edge 416 of an image slice 404. The printhead 300 may include a reference line sensor 326 configured to detect and/or sense the reference line 322 of an existing image slice 408 and transmit a path-following-error signal to the robot 202 causing the robot arm (FIG. 5) or high-bandwidth actuators 250 (see FIGS. 17-20) to correct or adjust the printhead 300 (e.g., in real time) such that the side edge 416 of the new image slice 406 is maintained in alignment with the side edge 416 of the existing image slice 408 during the printing of the new image slice 406. In this manner, the reference line 322 may allow the printhead 300 to precisely follow the rastering path 350 of a previously-printed image slice 404 such that the side edges 416 of the new and existing image slices 406, 408 (FIG. 7) are aligned in non-gapping and/or non-overlapping relation to one another, and thereby avoiding gaps between adjacent image slices 404 which may otherwise detract from the quality of the image 400.

Figure 2:
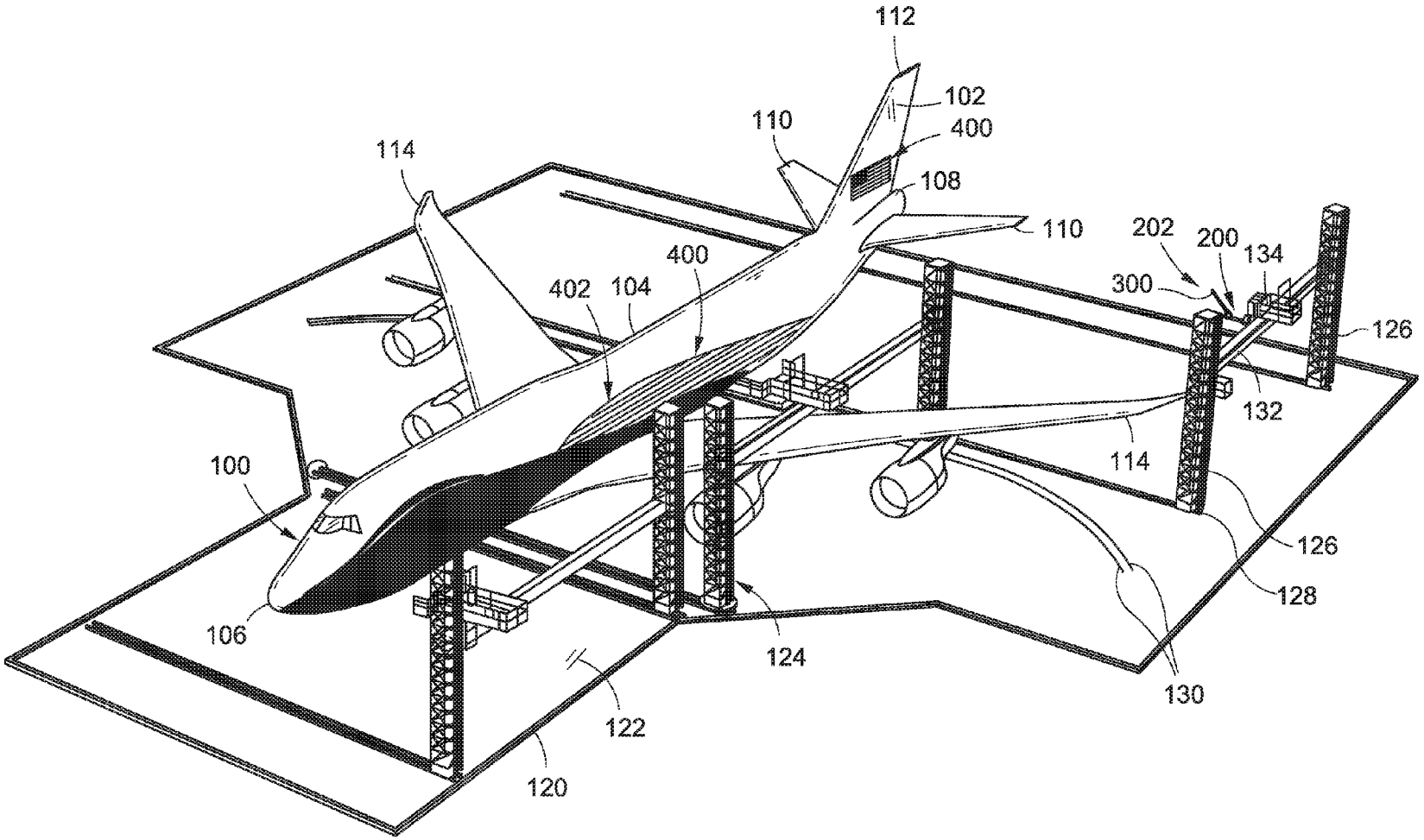
FIG. 2 is perspective view of an aircraft surrounded by a plurality of gantries supporting one or more image forming systems for printing one or more images on the aircraft.

FIG. 2 is perspective view of an aircraft 100 and a gantry system which may be implemented for supporting one or more image forming systems 200 as disclosed herein. The aircraft 100 may have a fuselage 104 having a nose 106 at a forward end and an empennage 108 at an aft end of the fuselage 104. The top of the fuselage 104 may be described as the crown, and the bottom of the fuselage 104 may be described as the keel. The aircraft 100 may include a pair of wings 114 extending outwardly from the fuselage 104. One or more propulsion units may be mounted to the aircraft 100 such as to the wings 114. The empennage 108 may include a horizontal tail 110 and a vertical tail 112.

In FIG. 2, the gantry system may be housed within a hangar 120 and may include a plurality of gantries 124 positioned on one or more sides on the aircraft 100. Each one of the gantries 124 may include a pair of vertical towers 126 that may be movable via a motorized base 128 along a floor track system 130 that may be coupled to or integrated into a floor 122. Each gantry 124 may include a crossbeam 132 extending between the towers 126. The crossbeam 132 of each gantry 124 may include a personnel platform 134. In addition, the crossbeam 132 may support at least one robot 202 that may be movable along the crossbeam 132. Advantageously, the gantry system may provide a means for positioning the robot 202 such that the printhead 300 has access to the crown, the keel, and other exterior surfaces 102 of the aircraft 100 including the sides of the fuselage 104, the vertical tail 112, the propulsion units, and other surfaces 102.

Although the system 200 and method of the present disclosure is described in the context of printing images on an aircraft 100, the system 200 and method may be implemented for printing images on any type of surface, with out limitation. In this regard, the surface 102 may be a surface of a motor vehicle including a tractor-trailer, a building, a banner, or any other type of movable or non-movable structure, object, article, or material having a surface to be printed. The surface may be planar, simply curved, and/or complexly curved.

Figure 3:
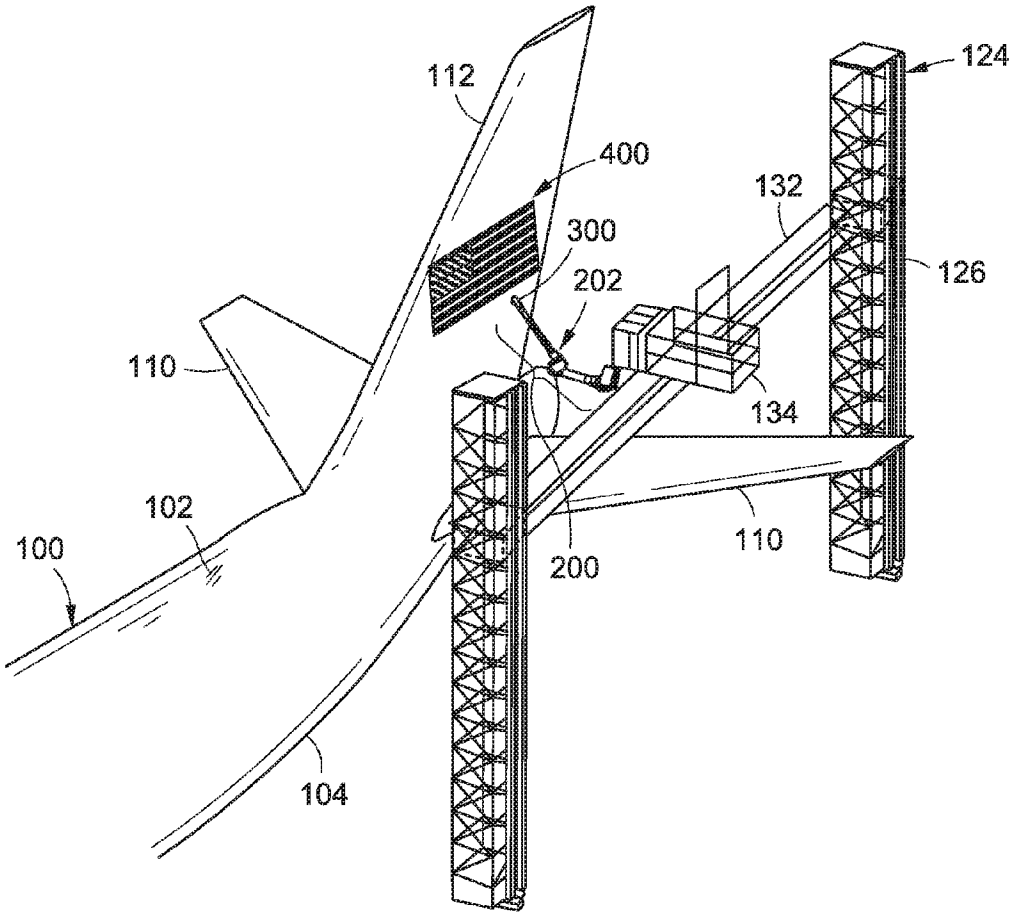
FIG. 3 is a perspective view of the aircraft showing one of the gantries positioned adjacent to a vertical tail and supporting an image forming system for printing an image on the vertical tail.

FIG. 3 shows a gantry 124 positioned adjacent to the vertical tail 112. A robot 202 mounted to the crossbeam may support an image forming system 200 for printing an image 400 on the vertical tail 112. In FIG. 3, the image 400 is shown as a flag which may be printed on the vertical tail 112 such as by using ink from an inkjet printhead 300. However, the printhead 300 may be configured to apply images using other fluids including, but not limited to paint, pigment, and/or other colorants and/or fluids. In addition, the image forming system 200 disclosed herein is not limited to forming graphic images.

In the present disclosure, the term "image" includes any type of coating that may be applied to a surface 102 (FIG. 2). An image may have a geometric design, any number of color(s) including a single color, and/or may be applied in any type of coating composition(s). In one example, the image 400 may include a graphic design, a logo, lettering, symbols, and/or any other types of indicia. In this regard, an image 400 may include an aircraft livery 402 which may comprise a geometric design or pattern that may be applied to the exterior surfaces 102 of an aircraft 100, as described above. The image 400 may include a reproduction of a photograph. Even further, an image 400 may be a monotone coating of paint, ink, or other colorant or fluid, and is not limited to a graphic design, logo, or lettering or other indicia.

Figure 4:
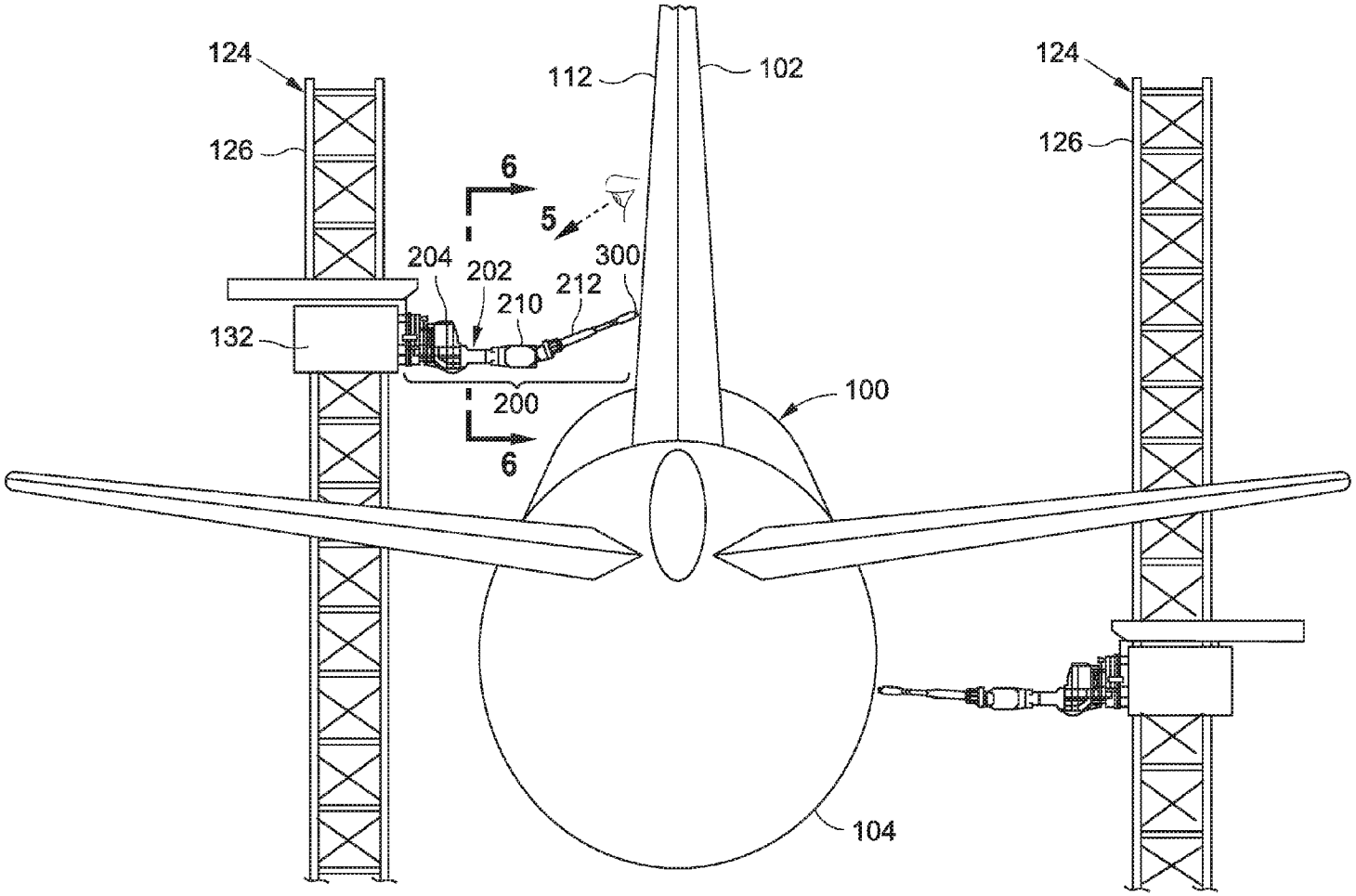
FIG. 4 is an end view of the aircraft showing image forming systems positioned on opposite sides of the aircraft.

FIG. 4 is an end view of an aircraft 100 showing image forming systems 200 positioned on opposite sides of the aircraft 100. Each image forming system 200 may include a robot 202 having one or more arms and a printhead 300 coupled to a terminal end 214 (FIG. 4) of the arm of the robot 202. One of the image forming systems 200 is shown printing an image 400 (e.g., a flag) on a vertical tail 112. The other image forming system 200 is shown a printing an image 400 such as the geometric design of an aircraft livery 402 (e.g., see FIG. 2) on a side of fuselage 104.

Although the robot 202 of the image forming system 200 is described as being mounted on a gantry 124 supported on a crossbeam 132 suspended between a pair of towers 126 (FIGS. 1-5), the robot 202 may be supported in any manner, without limitation. For example, the robot 202 may be suspended from an overhead gantry 124 (not shown). Alternatively, the robot 202 may be mounted on another type of movable platform. Even further, the robot 202 may be non-movably or fixedly supported on a shop floor (not shown) or other permanent feature.

Figure 5:
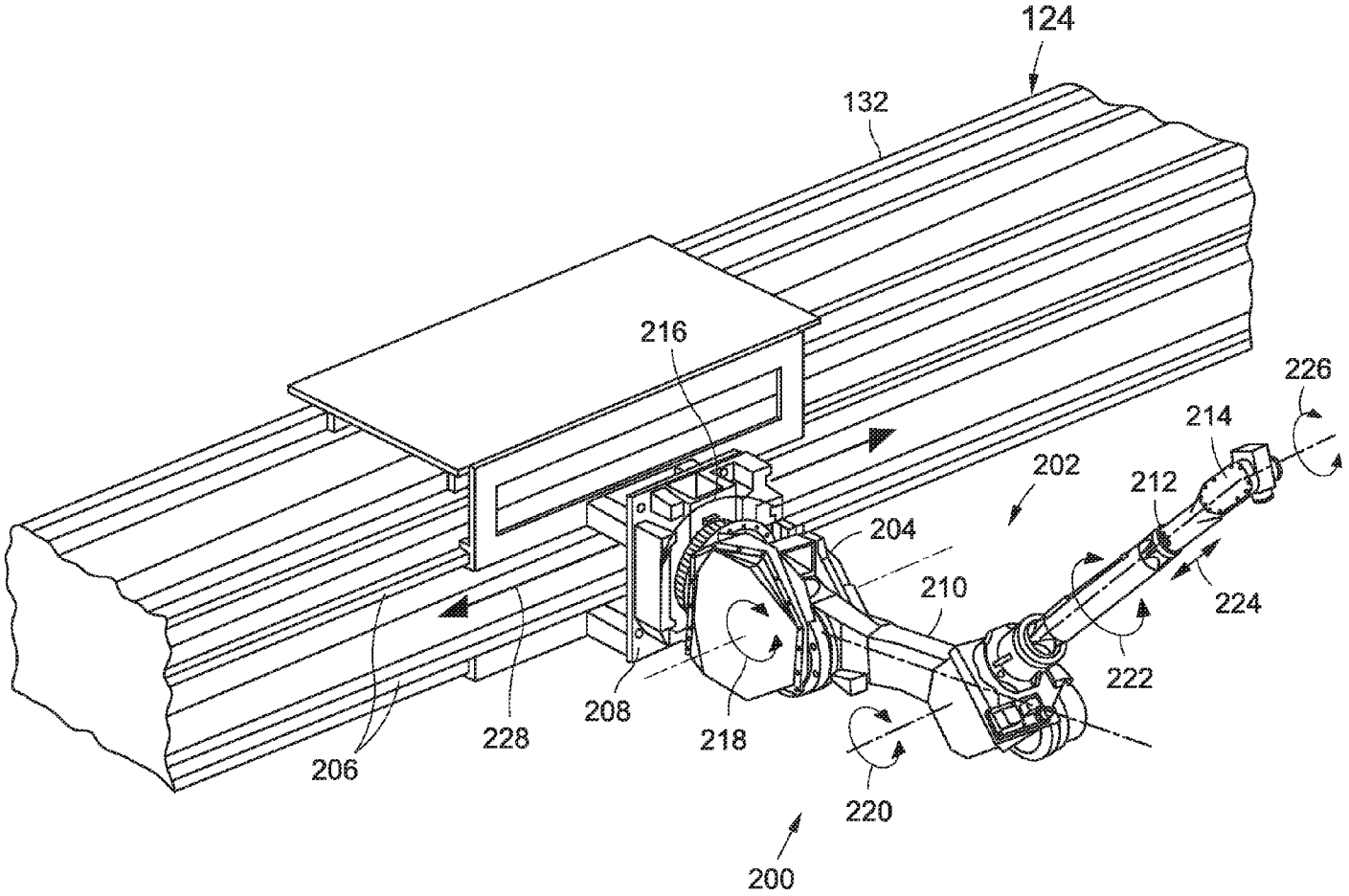
FIG. 5 is a perspective view of a robot taken along line 5 of FIG. 4 and illustrating the robot mounted to a crossbeam of a gantry and having a printhead mounted on an arm of the robot.

FIG. 5 is a perspective view of a robot 202 mounted to a crossbeam 132 of a gantry 124 and having a printhead 300 mounted on an arm of the robot 202. The robot 202 may be movable along guide rails 206 extending along a lengthwise direction of the crossbeam 132. In the example shown, the robot 202 may include a robot base 204, a first arm 210, and a second arm 212, with the printhead 300 mounted on the end 214 of the second arm 212. The robot base 204 may allow for rotation of the robot base 204 about a first axis 216 relative to the crossbeam 132. The first arm 210 may be rotatable about a second axis 218 defined by a joint coupling the first arm 210 to the robot base 204. The second arm 212 may be rotatable about a third axis 220 defined by a joint coupling the second arm 212 to the first arm 210. In addition, the second arm 212 may be swivelable about a fourth axis 222 extending along a length of the second arm 212. The length of the second arm 212 may be extendable and retractable to define a fifth axis 224 of movement.

In FIG. 4, 5 the printhead 300 is shown being rotatable about a sixth axis 226 defined by a joint coupling the printhead 300 to the second arm 212. The robot base 204 may include a robot drive system (not shown) for propelling the robot base 204 along the length of the crossbeam 132 and defining a seventh axis 228 of movement of the robot 202. The robot 202 may include a controller 208 for controlling the operation of the base 204, the arms, and/or the printhead 300. Although shown as having a first arm 210 and a second arm 212, the robot 202 may include any number of arms and joints for movement about or along any number of axes to allow the printhead 300 to reach any one of a variety of different locations and orientation relative to a surface 102. In some examples, the robot 202 may be devoid of a base 204 and/or the robot may comprise a single arm to which the printhead 300 may be coupled.

FIG. 6 is a side view of the image forming system 200 printing an image 400 on the vertical tail 112. The first arm 210 and second arm 212 may be movable relative to the base 204 of the robot 202 to position the printhead 300. The printhead 300 is movable by the arms over the surface 102 along one or more rastering paths 350 to print an image slice 404 on the surface 102. The printhead 300 may be moved along parallel rastering paths 350 to form parallel images slices 404 that collectively define the image 400. The robot 202 may be configured to maintain the orientation of the printhead face 304 parallel to the local position on the surface 102 as the printhead 300 is moved over the surface 102.

FIG. 7 shows an example of a printhead 300 being moved along a rastering path 350 to form an image slice 404. Each one of the rastering paths 350 is shown as being straight when viewed from above along a direction normal to the surface 102. However, the printhead 300 may be moved along a rastering path 350 that is curved or a combination of curved and straight. The printhead 300 may sequentially print a plurality of parallel image slices 404 side-by-side to collectively form an image 400 on the surface 102.

Figure 8:
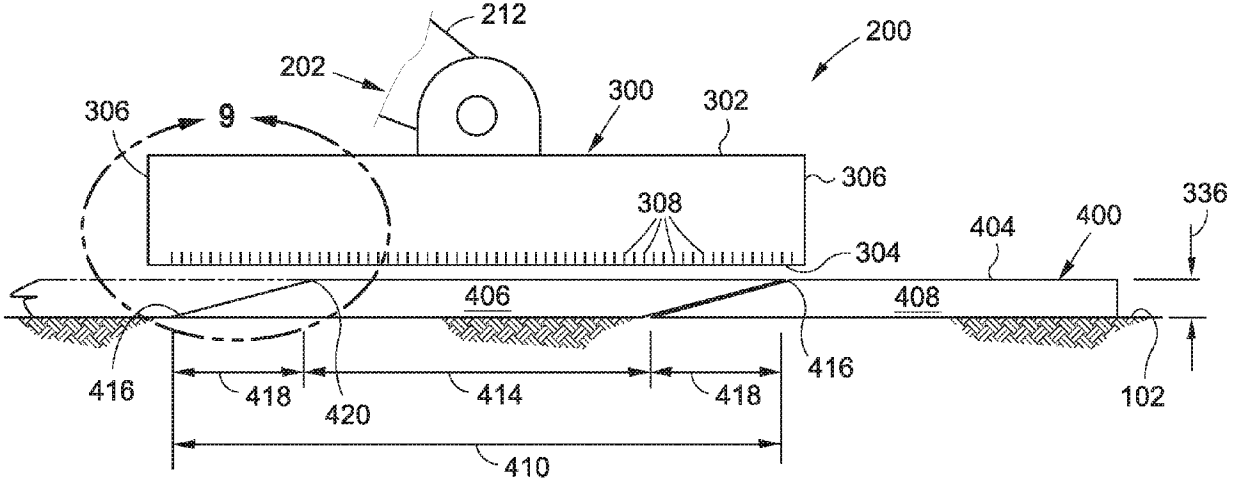
FIG. 8 is a sectional view of a printhead taken along line 8 of FIG. 7 and illustrating overlapping image gradient bands of the image slices printed by the printhead.

FIG. 8 is a sectional view of a printhead 300 printing image slices 404 on a surface 102. The printhead width 302 may be oriented parallel to a transverse direction 354 (FIG. 13) to the rastering path 350. The printhead 300 may include a plurality of nozzles 308 or orifices distributed between opposing widthwise ends 306 of the printhead 300. For example, an inkjet printhead may include thousands of orifices. The printhead 300 may eject droplets 330 (FIG. 10) of ink, paint, or other fluids from the orifices to form a coating having a coating thickness 336 on the surface 102.

Each image slice 404 (FIG. 8) may have opposing side edges 416 defining a bandwidth 410 of the image slice 404. The printhead 300 may be configured to print an image slice 404 with an image gradient band 418 along at least one of the side edges 416. In the example shown, an image slice 404 may contain an inner portion 414 bounded on opposite sides by an image gradient band 418. An image gradient band 418 may be described as a band within which the intensity of the color of the image slice 404 changes (e.g., decreases) along a transverse direction 354 relative to the direction of the rastering path 350 from an inner boundary 420 of the image gradient band 418 to the side edge 416. For example, the inner portion 414 of the image slice 404 may be black in color. Within the image gradient band, the color may gradually change from black at the inner boundary 420 (e.g., a relatively high intensity) to white (e.g., a relatively low intensity) at the side edge 416 of the image slice 404. An image gradient band 418 of an image slice 404 may be wider than the inner portion 414 of the image slice 404. For example, an image gradient band 418 may be no more than 30% the bandwidth 410 of the image slice 404.

The printhead 300 may be moved along the rastering paths 350 such that the image gradient bands 418 of the image slices 404 overlap. Advantageously, the overlapping rastering paths 350 allow for gaps and overlaps representing deviations from the nominal spacing between adjacent image slices 404 resulting in a reduced likelihood that such deviations from the nominal image slice spacing are visually perceptible. In this regard, the image gradient bands 418 on the side edges 416 of the adjacent image slices 404, when superimposed, result in imperceptible image edges even with imperfect tracking by the robot 202 along the rastering paths 350. In this manner, the image gradient bands 418 allow for printing of complex, intricate, and multi-colored images in multiple, single-pass image slices 404 on large-scale surfaces 102 using large-scale rastering devices such as the robot 202 shown in FIGS. 1-5.

Figure 9:
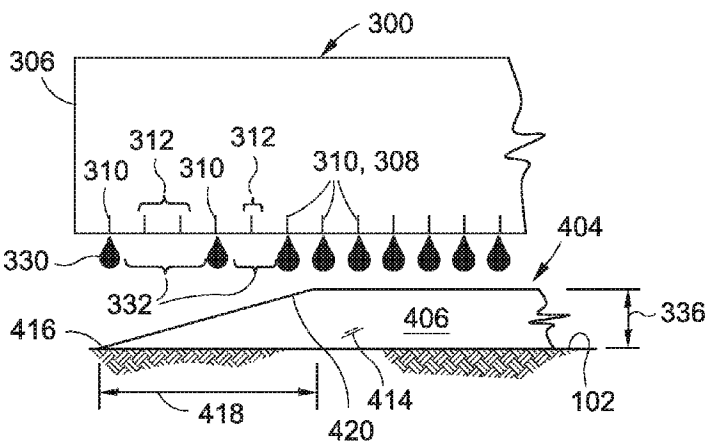
FIG. 9 is a magnified view of a portion of a printhead taken along line 9 of FIG. 8 and showing progressively increasing droplet spacings as may be ejected by active nozzles to form an image gradient band.

FIG. 9 is a magnified view of a printhead 300 showing one example for forming an image gradient band 418. As indicated above, the decrease in the intensity of the image gradient band 418 may be achieved by reducing or tapering the coating thickness 336 along a transverse direction 354 (FIG. 13) from the inner boundary 420 of the image gradient band 418 to the side edge 416 of the image slice 404. The droplet spacing 332 may be uniform within the inner portion 414 of the image slice 404. In FIG. 9, the coating thickness 336 within the image gradient band 418 may be tapered by progressively increasing the droplet spacing 332 between the droplets 330 ejected by the nozzles 308. In this regard, some of the nozzles 308 (e.g., orifices) of the printhead 300 in the area wherein the image gradient band 418 is to be printed may be electronically deactivated and may be referred to as inactive nozzles 312, and only active nozzles 310 within the image gradient band 418 may eject droplets 330 to form the image gradient band 418. In other examples, the printhead 300 may be provided with progressively larger gaps between nozzles 308 for the area wherein the image gradient band 418 is to be printed.

Figure 10:
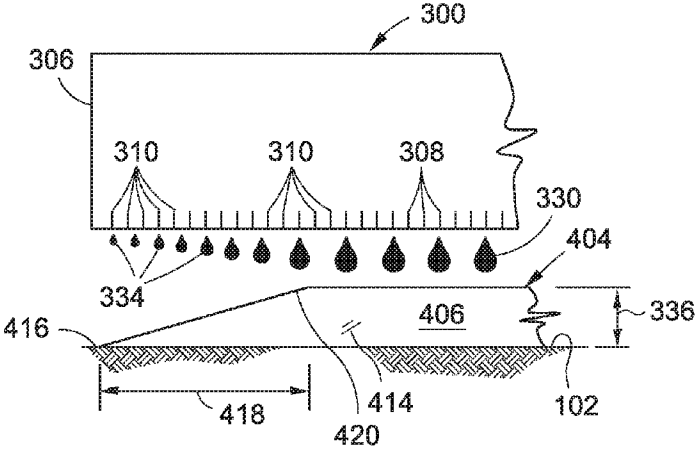
FIG. 10 is a magnified view of a portion of a printhead showing progressively decreasing droplet sizes as may be ejected by the nozzles to form an image gradient band.

FIG. 10 is a magnified view showing another example of a printhead 300 forming an image gradient band 418 by maintaining the nozzles 308 as active nozzles 310 producing a uniform droplet spacing, and progressively decreasing the droplet size 334 in the area where the image gradient band 418 is to be formed. In still further examples, and image gradient band 418 may be formed by a combination of controlling the droplet spacing 332 and controlling the droplet size 334. However, other techniques may be implemented for forming image gradient band 418 and are not limited to the examples shown in the Figures and described above. The printhead 300 may be configured to form the image gradient band 418 with an image gradient that is linearly decreasing. Alternatively, the image gradient within the image gradient band 418 may be non-linear.

Figure 11:
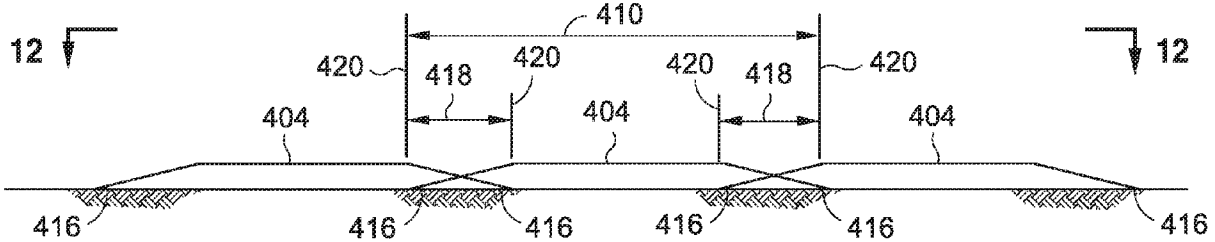
FIG. 11 is a diagrammatic sectional view of adjacent image slices with overlapping image gradient bands.
Figure 12:
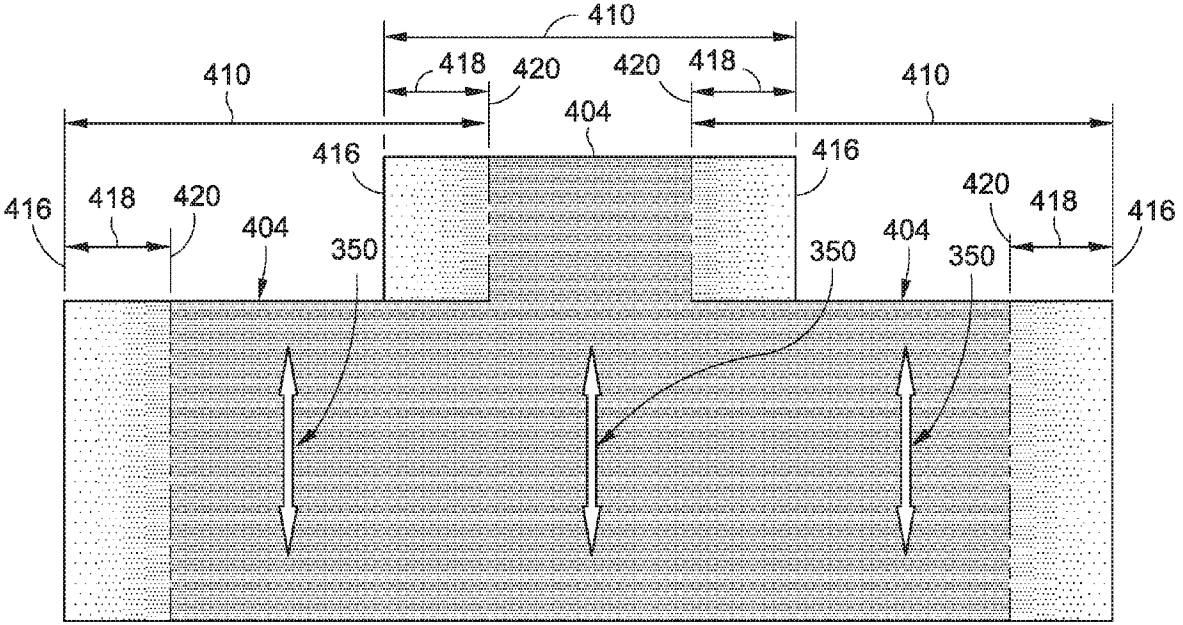
FIG. 12 is a plan view of the adjacent image slices of FIG. 11 showing the overlapping image gradient bands.

FIG. 11 is a diagrammatic sectional view of adjacent image slices 404 with overlapping image gradient bands 418. Shown is the coating thickness 336 (FIG. 10) in the image gradient band 418 and in the inner portion 414 of each image slice 404. FIG. 12 is a plan view of the image slices 404 of FIG. 11 showing the overlapping image gradient bands 418 and the parallel rastering paths 350 of the image slices 404. In the system 200 as shown, the arm (FIG. 7) may move the printhead 300 to print a new image slice 406 in parallel relation to an existing image slice 408 (e.g., a previously-printed image slice 404) in a manner such that an image gradient band 418 of the new image slice 406 (FIG. 8) overlaps an image gradient band 418 of the existing image slice 408. In this regard, the side edge 416 of each image slice 404 may be aligned with an inner boundary 420 of an overlapping or overlapped image gradient band 418. However, in an example not shown, the printhead 300 may print image slices 404 in a manner to form a gap between the side edge 416 of an image gradient band 418 of a new image slice 406 and an existing image slice 408. As indicated above, the printhead 300 may print the image gradient band 418 of the new image slice 406 and the existing image slice 408 such that the overlap has an image intensity equivalent to the image intensity of the inner portion 414 of the new image slice 406 and/or the existing image slice 408.

In a still further example not shown, the printhead 300 (FIG. 10) may form an image gradient end on at least one of opposing ends of an image slice 404. An image gradient end may have an image intensity that may decrease toward an end edge (not shown) of the image slice 404. Such an image gradient end may provide a means for blending (e.g., feathering) the image slice 404 with the color and design of the existing color and design of the surface 102 area surrounding the newly-applied image 400. For example, the system may apply a newly-applied image 400 to a portion of a surface that may have undergone reworking such as the removal and/or replacement of a portion of a composite skin panel (not shown) and/or underlying structure. The image gradient ends of the newly-applied image slices 404 may provide a means for blending into the surrounding surface 102. The image gradient end may also facilitate the blending on a new image slice 406 with the image gradient end of another image 400 located at an end of a rastering path 350 of the new image slice 406.

Figure 13:
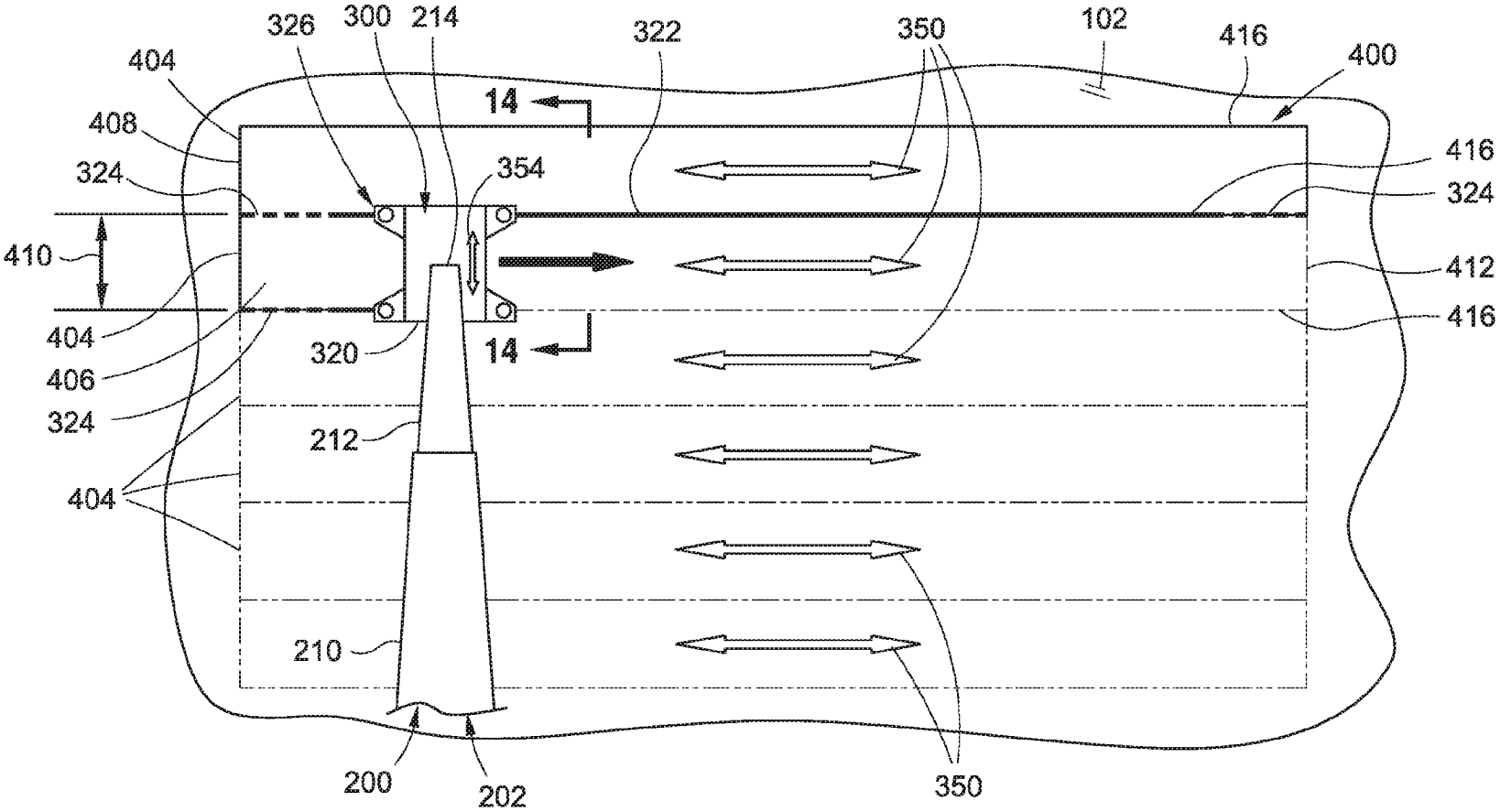
FIG. 13 is an example of a printhead printing a reference line while printing a new image slice.

Referring to FIG. 13, shown is an example of a printhead 300 mounted on an end 214 of a robot arm and being movable by the arm over a surface 102 along a rastering path 350 while printing a new image slice 406 adjacent to an existing image slice 408. The printhead 300 may include a reference line printing mechanism 320 configured to print a reference line 322 when printing the new image slice 406. The reference line 322 may provide a means for the printhead 300 to precisely track the rastering path 350 of an existing image slice 408. The printhead 300 may include a reference line sensor 326 such as an image detection system for sensing the reference line 322 and providing path error feedback to the controller 208 (FIG. 14) to allow the robot 202 to generate path correction inputs to the printhead 300 such that the side edge 416 of the new image slice 406 is maintained in alignment with the side edge 416 of the existing image slice 408.

Figure 14:
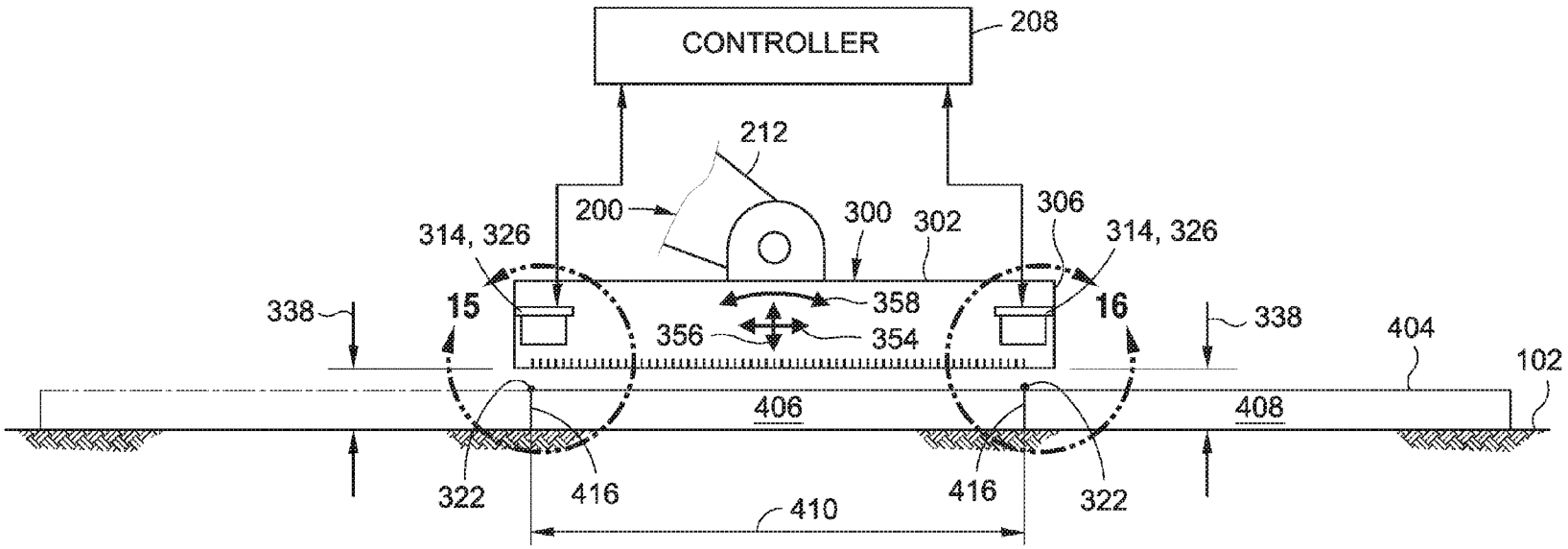
FIG. 14 is a sectional view taken along line 14 of FIG. 13 and illustrating a printhead including a reference line printing mechanism and one or more reference line sensors for sensing the reference line of an existing image slice.

FIG. 14 shows an example of a printhead 300 printing an image slice 404 adjacent to an existing image slice 408. The existing image slice 408 may include a reference line 322 along one of the side edges 416. The printhead 300 may have one or more reference line sensors 326 mounted on each one of the widthwise ends 306 of the printhead 300. One of the reference line sensors 326 may be configured to sense the reference line 322 of an existing image slice 408. In addition, the printhead 300 may include one or more position sensors 314 for monitoring the position and/or orientation of the printhead 300 relative to the surface 102. In some examples, the reference lines 322 sensor may be configured as position sensors 314 to sense the position and/or orientation of the printhead 300 in addition to sensing the reference line 322.

The position sensors 314 at one or both of the widthwise ends 306 of the printhead 300 may measure a normal spacing 338 of the printhead 300 from the surface 102 along a direction locally normal to the surface 102. Feedback provided by the position sensors 314 to the controller 208 may allow the controller 208 to adjust the arm position such that the face of the printhead 300 is maintained at a desired normal spacing 338 from the surface 102 such that the droplet may be accurately placed on the surface 102. In further examples, the controller 208 may use continuous or semi-continuous feedback from the position sensors 314 to rotate the printhead 300 as necessary along a roll direction 358 such that the face of the printhead 300 is maintained parallel to the surface 102 as the printhead 300 is moved over the surface 102 which may have a changing and/or curved contour.

Figure 15:
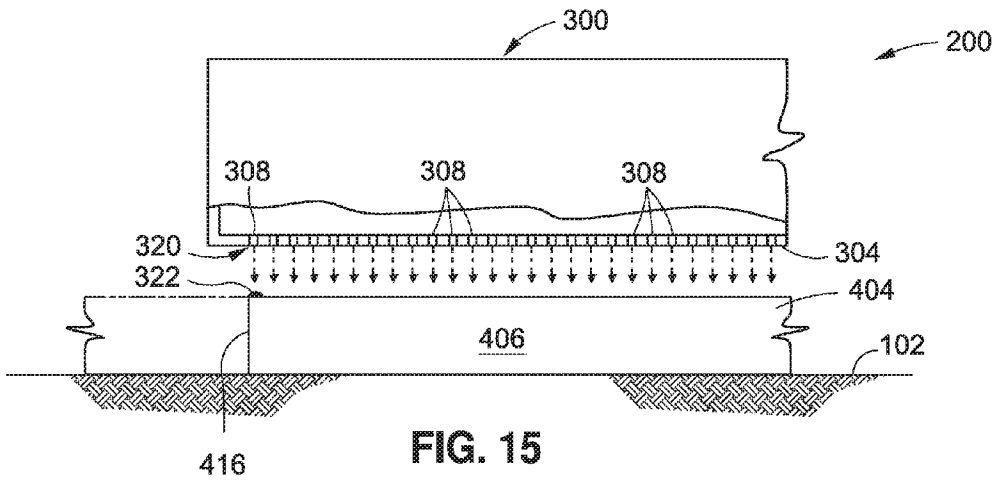
FIG. 15 is a magnified view taken long line 15 of FIG. 14 and showing one of the nozzles of the printhead printing the reference line while the remaining nozzles of the printhead print the image slice.

FIG. 15 shows an example of a printhead 300 wherein the reference line printing mechanism 320 comprises one or more dedicated nozzles 308 configured to print the reference line 322 on at least one of opposing side edges 416 of a new image slice 406. The remaining nozzles 308 of the printhead 300 may be configured to print the image slice 404. In other examples not shown, the reference line printing mechanism 320 may comprise a dedicated line-printing device that may be mounted on the printhead 300 and configured to print a reference line 322 while the nozzles 308 of the printhead 300 print the image slice 404.

The printhead 300 may print the reference line 322 to be visible within a certain spectrum such as the visible spectrum and/or the infrared spectrum. In some examples, the reference line 322 may have a thickness that prevents detection by the human eye beyond a certain distance (e.g., more than 10 feet) from the surface 102. In other examples, the reference line 322 may be printed as a series of spaced dots (e.g., every 0.01 inch) which may be visually imperceptible beyond a certain distance to avoid detracting from the quality of the image. In still other examples, the color of the reference line 322 may be imperceptible relative to the local color of the image 400, or the reference line 322 may be invisible in normal ambient lighting conditions (e.g., shop light or sunlight) and may be fluorescent under a fluorescent light that may be emitted by the reference line sensor 326. Even further, the reference line 322 may be invisible within the visible spectrum, or the reference line 322 may initially be visible under ambient light and may fade over time under ambient conditions such as due to exposure to ultraviolet radiation.

In still further examples, the reference line 322 may be printed with at least one encoding pattern 324 (e.g., see FIG. 13) along at least a portion of the reference line 322. The encoding pattern 324 may comprise a system of line segments or dashes separated by gaps. The encoding pattern 324 may represent information about the image slice 404. For example, the encoding pattern 324 may represents information regarding the distance from the current location (e.g., the location where the encoding pattern 324 is currently detected) of the printhead 300 relative to an end 412 of the image slice 404. Such information may be included in the signal transmitted to the controller 208 to allow the controller 208 to control the operation of the printhead 300. For example, the encoding pattern 324 may signal the controller 208 to synchronize or align a new image slice 406 being printed with the existing image slice 408, or to signal to the controller 208 to halt the ejection of droplets 330 in correspondence with the end of the existing image slice 408.

Figure 16:
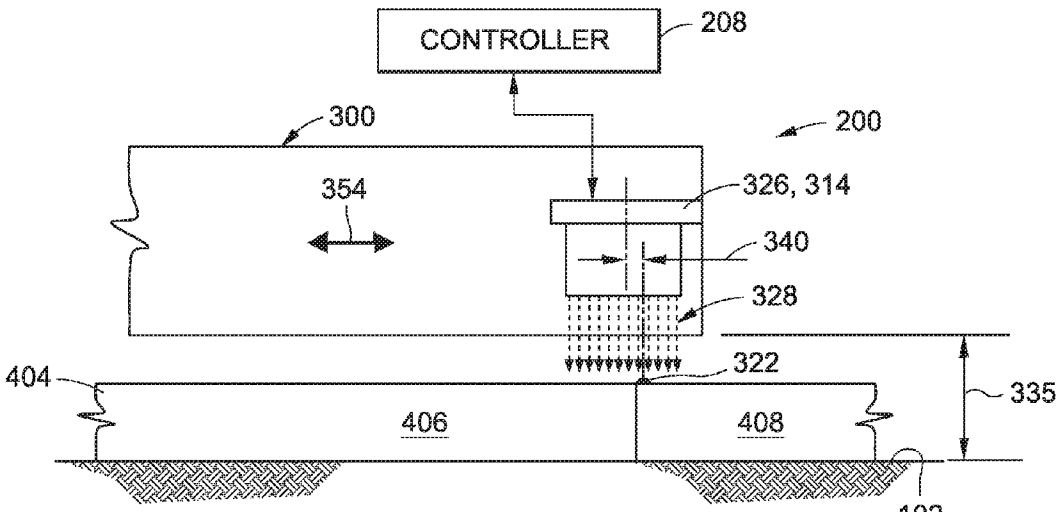
FIG. 16 is a magnified view of an example of a printhead having a reference line sensor for sensing the reference line of an existing image slice.

FIG. 16 is a magnified view of an example of a printhead 300 having a reference line sensor 326 for sensing a reference line 322 of an image slice 404. The reference line sensor 326 may transmit to the controller 208 (FIG. 14) a path-following-error signal representing the lateral spacing 340 between the reference line 322 and an indexing feature. The indexing feature may be the centerline of the reference line sensor 326, a hardpoint on the printhead 300 such as the nozzle 308 at an extreme end of the printhead 300, or some other indexing feature. As the printhead 300 is moved along a rastering path 350, the reference line sensor 326 may sense and transmit (e.g., continuously, in real-time) the path-following-error signal to the controller 208 representing the lateral spacing 340. Based 204 on the signal, the controller 208 may cause the lateral position of the printhead 300 to be adjusted (e.g., by the arm) such that the side edge 416 of the new image slice 406 is maintained in alignment with the side edge 416 of an existing image slice 408.

The reference line sensor 326 may be configured as an optical sensor of a vision system. In FIG. 16, the optical sensor may emit an optical beam 328 for detecting the reference line 322. The optical sensor may generate a signal representing the lateral location where the optical beam 328 strikes the reference line 322. The signal may be transmitted to the robot 202 controller 208 on demand, at preprogrammed time intervals, continuously, or in other modes. In one example, the reference line sensor 326 may provide real-time alignment feedback to the robot 202 controller 208 for manipulating or adjusting the printhead 300 such that the side edges 416 of the new image slice 406 and existing image slice 408 are aligned. For example, the robot 202 may adjust the lateral position of the printhead 300 such that the side edges 416 of the new image slice 406 and the existing image slice 408 are aligned in non-gapped and/or non-overlapping relation as a new image slice 406 is being printed.

In other examples, instead of adjusting the lateral position of the printhead 300, the robot controller 208 may maintain the lateral position of the printhead 300 during movement along the rastering path 350, and the controller 208 may electronically control or shift the nozzles 308 on the printhead 300 that are actively ejecting droplets 330. In this regard, a printhead 300 may have additional (e.g., unused) nozzles 308 located at one or both of the widthwise ends 306 of the printhead 300. Upon the controller 208 determining that a new image slice 406 is misaligned with an existing image slice 408, the controller 208 may activate one or more of the unused nozzles 308 at one of the widthwise ends 306, and deactivate an equal number of nozzles 308 at an opposite widthwise end 306 of the printhead 300 to maintain the same image slice width of the new image slice 406 while effectively shifting the lateral position of the new image slice 406 without laterally moving the printhead 300. In this regard, an image slice 404 may be electronically offset in real-time or near real-time such that the side edge 416 of the new image slice 406 is maintained in non-gapping and/or non-overlapping relation with the side edge 416 of an existing image slice 408. In this manner, the reference line 322 advantageously provides a means for the printhead 300 to precisely maintain a nominal distance of a new image slice 406 relative to the rastering path 350 of an existing or previous-applied image slice 404, and thereby avoid gap between the image slices 404.

Figure 17:
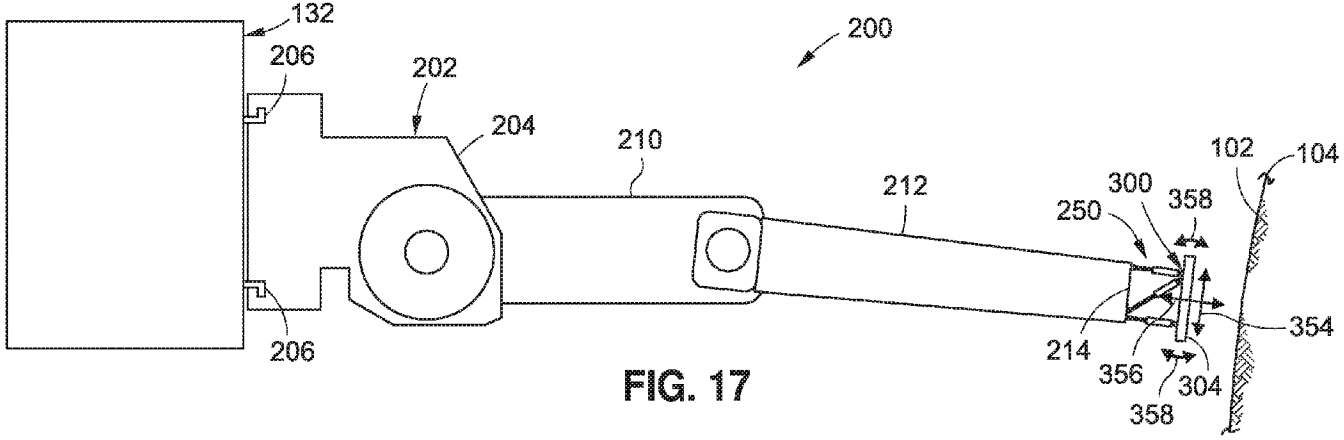
FIG. 17 is a side view of an example of a robot having one or more high-bandwidth actuators coupling the printhead to an arm of the robot.

FIG. 17 is a side view of an example of a robot 202 having high-bandwidth actuators 250 coupling the printhead 300 to an arm of the robot 202 and showing the printhead 300 printing an image 400 (e.g., an aircraft livery 402) on a surface 102 of a fuselage 104. As indicated above, a relatively large robot 202 may be required for printing large surfaces 102. Such a large-scale robot 202 may have a relatively high mass and relatively low stiffness which may result in an inherently large tolerance band of movement at the end 214 of the arm (e.g., the last axis of the robot) on which the printhead 300 may be mounted. In attempts to compensate for such inherently large tolerances, a large-scale robot 202 may require extensive computer programming (e.g., CNC or computer-numerical-control programming) which may add to production cost and schedule. Advantageously, by printing image slices 404 with the above-described image gradient bands 418 (FIGS. 7-12) and/or reference lines 322 (FIGS. 13-16), the robot-mounted printhead 300 of the present disclosure may print a high-quality image 400 on a surface 102 without the occurrence of gaps between adjacent image slices 404 that would otherwise detract from the overall quality of the image.

In FIG. 17, one or more high-bandwidth actuators 250 may be mounted in series with the one or more arms of the robot 202. Such high-bandwidth actuators 250 may couple the printhead 300 to the last axis or arm of the robot 202 and provide a relatively small tolerance band for adjusting the an orientation and/or position of the printhead 300 relative to the surface 102 during movement of the printhead 300 along a rastering path 350 such that a new image slice 406 may be accurately aligned with an existing image slice 408. The high-bandwidth actuators 250 may be described as high-bandwidth in the sense that the high-bandwidth actuators 250 may have small mass and inherently high stiffness which may result in increased precision and rapid response time in positioning and orienting a printhead 300 relative to the large mass, low stiffness, and corresponding slow response time of a large-scale robot 202. Further in this regard, the high-bandwidth actuators 250 may rapidly respond to commands from the robot controller 208 based on path-following-error signals provided in real-time by the reference line sensor 326.

Referring still to FIG. 17, the system 200 may include one or more high-bandwidth actuators 250 which may be configured to adjust the position of the printhead 300 along at least one of the following directions: (1) a transverse direction 354 of translation of the printhead 300 parallel to the surface 102 and perpendicular to the rastering path 350, (2) a normal direction 356 of translation of the printhead 300 locally normal to the surface 102, and (3) a roll direction 358 of rotation of the printhead 300 about an axis parallel to the rastering path 350. In addition, one or more high-bandwidth actuators 250 may be configured to adjust the position of the printhead 300 along other directions including, but not limited to, a parallel direction 352 of translation which may be described as parallel to the primary direction of movement of the printhead 300 along the rastering path 350 during the printing of an image slice 404.

Figure 18:
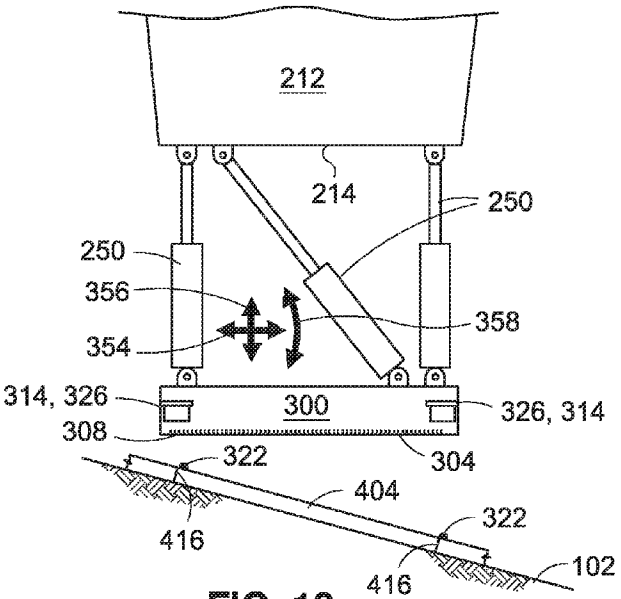
FIG. 18 is a side view of an example of a plurality of high-bandwidth actuators coupling a printhead to an arm of a robot.

FIG. 18 shows an example of three (3) high-bandwidth actuators 250 coupling a printhead 300 to an arm of a robot 202 (FIG. 17). In an embodiment, the high-bandwidth actuators 250 include a first actuator 250*a*, a second actuator 250*b*, and a third actuator 250*c* which may be generally aligned in an in-plane tripod configuration enabling adjustment of the printhead 300 along the transverse direction 354, the normal direction 356, and the roll direction 358 as described above. The first, second, and third actuators 250*a*, 250*b*, 250*c* may each have an upper end 268 and a lower end 270. The upper ends 268 of the first, second, and third actuators 250*a*, 250*b*, 250*c* may be pivotably coupled to the end of the arm of the robot and may have parallel pivot axes. The lower ends 270 of the first, second, and third actuators 250*a*, 250*b*, 250*c* may be pivotably coupled to the printhead 300 and may also have parallel pivot axes. As shown in FIG. 18, the upper ends 268 of the first 250*a* and third actuator 250*c* are spaced apart from one another at the pivotable attachment to the end of the arm 214, and the lower ends 270 of the first 250*a* and third actuator 250*c* are spaced apart from one another at the pivotable attachment to the printhead 300. In this regard, the first actuator 250*a* and the third actuator 250*c* may be oriented generally parallel to one another. However, the first actuator 250*a* and the third actuator 250*c* may be oriented non-parallel relation to one another without detracting from the movement capability of the printhead 300 along the transverse direction 354, the normal direction 356, and the roll direction 358.

In FIG. 18, the upper end 268 of the second actuator 250*b* may be located adjacent to the upper end 268 of the first actuator 250*a*. The lower end 270 of the second actuator 250*b* may be located adjacent to the lower end 270 of the third actuator 250*c* such that the second actuator 250*b* extends diagonally between the upper end 268 of the first actuator 250*a* and the lower end 270 of the third actuator 250*c*. In operation, the first, second, and third actuators 250*a*, 250*b*, 250*c* may be extended and retracted by different amounts to adjust the printhead 300 along the transverse direction 354, the normal direction 356, and the roll direction 358. In any one of the examples disclosed herein, one or more of the high-bandwidth actuators 250 may be configured as pneumatic cylinders or in other high-bandwidth actuator configurations including, but not limited to, hydraulic cylinders, electromechanical actuators, or other actuator configurations. In FIG. 18, the printhead face 304 is oriented non-parallel to the surface 102 and laterally offset relative to the reference line 322.

Figure 19:
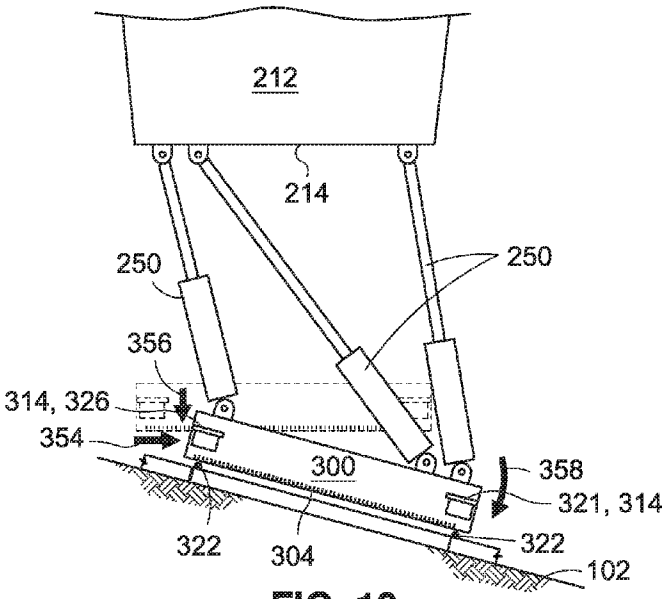
FIG. 19 is a side view of the printhead after repositioning by the high-bandwidth actuators into alignment with the reference line and reorientation of the printhead face parallel to the surface.

FIG. 19 is a side view of the printhead 300 after being repositioned by the high-bandwidth actuators 250 (e.g., the first, second, and third actuators 250*a*, 250*b*, 250*c*) into alignment with the reference line 322 and reorientation of the printhead face 304 into parallel relation with the surface 102. In this regard, the controller 208 (FIG. 14) may command the translation and re-orientation of the printhead 300 based on continuous input signals that may be received in real-time from the position sensors 314 and/or reference line sensors 326 tracking the reference line 322 during printing of a new image slice 406. For example, the high-bandwidth actuators 250 may translate the printhead 300 along the transverse direction 354 and the normal direction 356 and may rotate the printhead 300 along the roll direction 358 to orient the printhead face 304 parallel the local surface 102 while aligning the side edge 416 of a new image slice 406 with the side edge 416 of an existing image slice 408.

Figure 20:
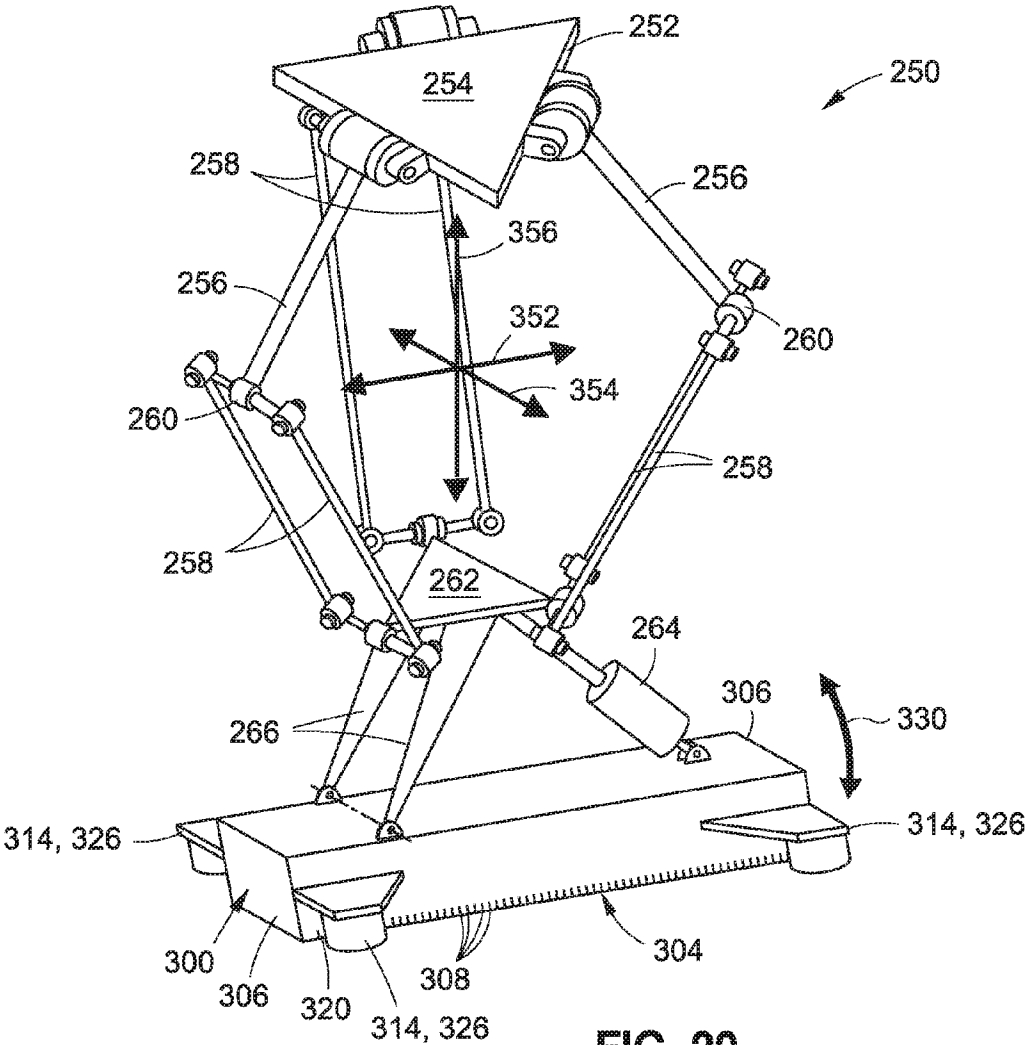
FIG. 20 is a perspective view of an example of a delta robot having a plurality of high-bandwidth actuators coupling the printhead to an arm of a robot.

FIG. 20 is a further example of high-bandwidth actuators 250 configured as a delta robot 252 and mounted in series with the robot arm and coupling the printhead 300 to the end 214 (FIG. 19) of the robot arm (FIG. 17). In FIG. 20, the delta robot 252 may include an actuator base 254 which may be attached to the end 214 of a robot arm (e.g., a second arm 212). Three (3) actuator upper arms 256 may be pivotably coupled to the actuator base 254 and may have co-planar pivot axes oriented at 60 degrees relative to one another. Each actuator upper arm 256 may be coupled by a hinge joint 260 to a pair of actuator lower arms 258. Each pair of actuator lower arms 258 may be configured as a parallelogram four-bar-mechanism. Each one of three (3) pairs of lower arms 258 may be pivotably coupled to an actuator platform 262 through six (6) hinge joints wherein each hinge joint is capable of rotation about a single axis. The three (3) parallelogram four-bar-mechanisms of the three (3) actuator lower arms 258 limit movement of the actuator platform 262 to translation (e.g., movement in the x-y direction) and extension (e.g., movement in the z-direction), and prevent rotation of the actuator platform 262. In this regard, the actuator platform 262 is maintained in parallel relation with the actuator base 254 regardless of the direction of translation and/or extension of the actuator platform 262. In an example not shown, the delta robot 252 may be provided with spherical joints (not shown) and upper and lower arms (not shown) arranged in a manner that maintains the actuator platform 262 in parallel relation to the actuator base 254 during translation and/or extension of the actuator platform 262.

In FIG. 20, the translation capability of the actuator platform 262 provides for translation of the printhead 300 along the above-described transverse direction 354 (e.g., the y-direction) and normal direction 356 (e.g., the z-direction) relative to the surface 102 being printed. The high-bandwidth actuator 250 arrangement of FIG. 20 may provide rotational capability of the printhead 300 along the roll direction 358 by means of one or more roll actuators 264 for pivoting the printhead 300 about one or more attachment links 266. The upper ends of the attachment links 266 may be fixedly coupled to the actuator platform 262. The lower ends of the attachment links 266 may be pivotably coupled to the printhead 300. The high-bandwidth actuator 250 arrangement of FIG. 20 may represent a low mass, high stiffness actuator system providing increased precision and improved response time for adjusting the position of the printhead 300 according to a path-following-error that may be resolved using the reference line sensor 326 tracking the reference line 322 of an existing image slice 408. As indicated above, the high-bandwidth actuators 250 may adjust the position and/or orientation of the printhead 300 with a precision that may be unobtainable with the robot 202 acting alone.

Figure 21:
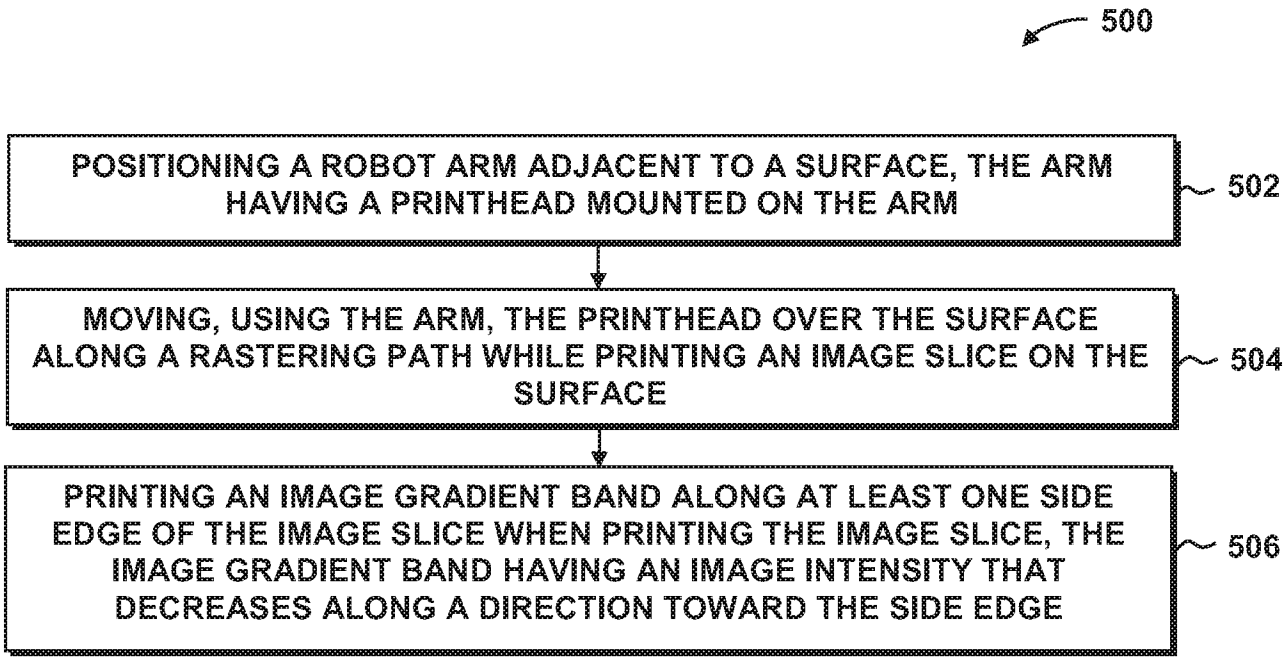
FIG. 21 is a flowchart having one or more operations that may be included in method of printing an image on a surface wherein the parallel image slices each have one or more image gradient bands along the side edges of the image slices.

FIG. 21 is a flowchart of one or more operations that may be included in method 500 of printing an image 400 on a surface 102. The method may be implemented using the system 200 described above. Step 502 of the method 500 may include positioning an arm of a robot 202 adjacent to a surface 102. As indicated above, a printhead 300 may be mounted on an end 214 of the arm. In some examples, the printhead 300 may be an inkjet printhead 300 having an array of nozzles 308 or orifices for ejecting droplets 330 of ink, paint, or other fluids or colorants.

Step 504 of the method 500 may include moving, using the arm, the printhead 300 over the surface 102 along a rastering path 350 while the printhead 300 prints an image slice 404 on the surface 102, as shown in FIG. 7. The printhead 300 may be moved by the arm along the rastering path 350 to print a new image slice 406 in parallel relation to an existing image slice 408.

Step 506 of the method 500 may include printing an image gradient band 418 along at least one side edge 416 of an image slice 404 when printing the image slice 404 on the surface 102, as shown in FIG. 8. As described above, the image gradient band 418 may have an image intensity that decreases along a transverse direction 354 (e.g., relative to the rastering path 350) toward a side edge 416 of the image slice 404. In some examples, the image gradient of the image gradient band 418 may be linear (e.g., a linear decrease in the image density) along the transverse direction 354. In other examples, the image gradient of an image gradient band 418 may be non-linear.

As shown in FIG. 8, a printhead 300 may print a new image slice 406 such that the image gradient band 418 of the new image slice 406 overlaps the image gradient band 418 of an existing image slice 408. For example, the side edge 416 of the new image slice 406 may be aligned with an inner boundary 420 of an overlapping or overlapped image gradient band, as mentioned above. The method may include printing, using the printhead 300, the image gradient band 418 of the new image slice 406 and the existing image slice 408 such that the overlapping image gradient bands 418 have a collective image intensity that is equivalent to the image intensity of the inner portion 414 of the new image slice 406 and/or the existing image slice 408

As shown in FIG. 9 and mentioned above, an image gradient band 418 may be generated by ejecting droplets 330 from the printhead 300 nozzles 308 with progressively larger droplet spacings 332 along a direction toward the side edge 416 of the image slice 404 as compared to a uniform droplet spacing 332 for the nozzles 308 that print the inner portion 414 of the image slice 404. As shown in FIG. 10, an image gradient band 418 may also be generated by ejecting progressively smaller droplet sizes 334 along a direction toward the side edge 416. The method may optionally include forming a new image slice 406 with an image gradient end (not shown) on at least one of opposing ends of the new image slice 406 as a means to blend or feather the image slice 404 into an area bordering the new image slice 406.

Figure 22:
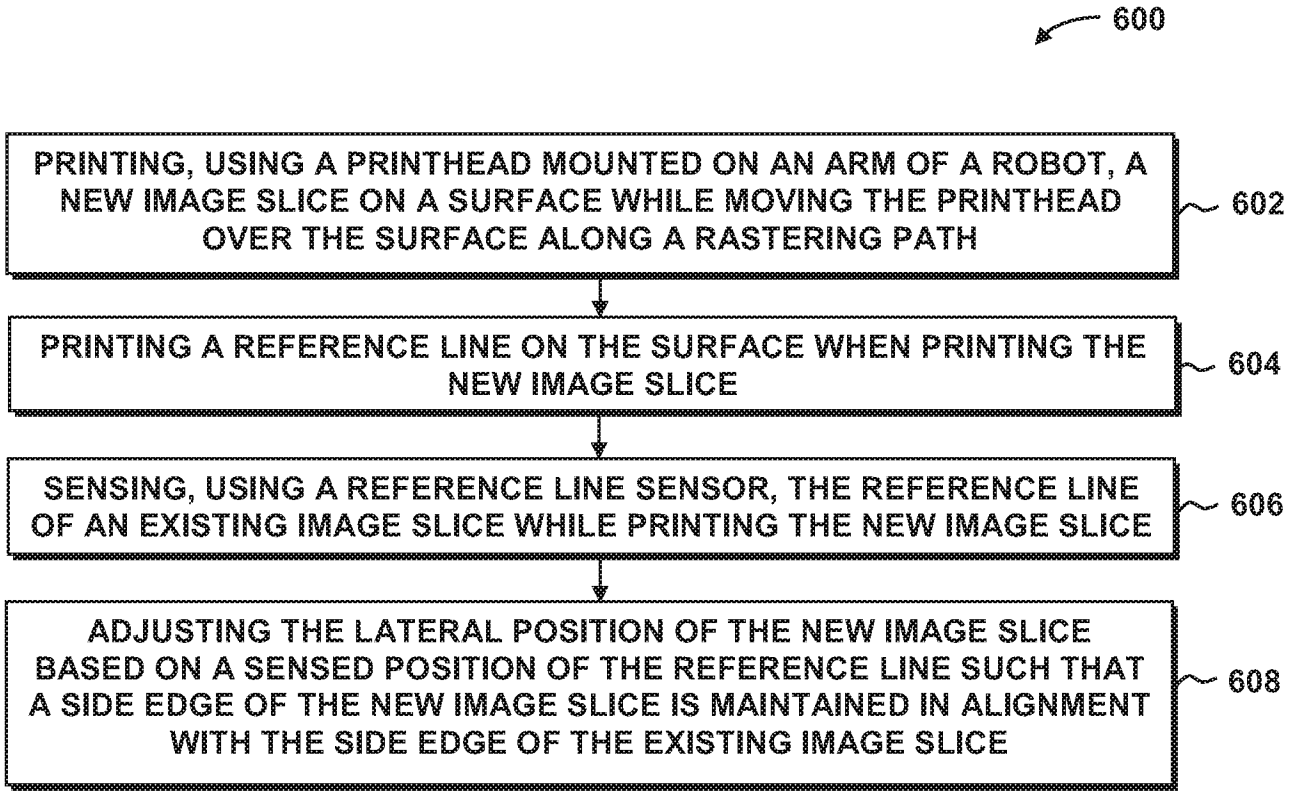
FIG. 22 is a flowchart having one or more operations that may be included in a method of printing an image on a surface wherein the image slices have a reference line for aligning a new image slice with an existing image slice.

FIG. 22 is a flowchart of one more operations that may be included in a further method 600 of printing an image 400 on a surface 102. Step 602 of the method 600 may include printing, using a printhead 300 mounted on an arm of a robot 202, a new image slice 406 on the surface 102 while moving the printhead 300 over the surface 102 along a rastering path 350. Step 604 of the method 600 may include printing a reference line 322 on the surface 102 when printing the new image slice 406, as shown in FIG. 13 and described above. The printhead 300 may include a reference line printing mechanism 320 configured to print the reference line 322 on the surface 102 when printing the new image slice 406. In some examples, the reference line printing mechanism 320 may comprise at least one nozzle 308 of the printhead 300 which may eject ink or paint that is a different color that the ink or paint ejected by adjacent nozzles 308. In other examples, the reference line printing mechanism 320 may comprise a dedicated reference line printer (not shown).

The printhead 300 may print a reference line 322 on at least one of opposing side edges 416 of a new image slice 406 when printing the new image slice 406. The step of printing the reference line 322 may include printing the reference line 322 with at least one encoding pattern 324 along at least a portion of the reference line 322. The encoding pattern 324 may comprise a series of line segments separated by gaps. The encoding pattern 324 may alternatively or additionally comprise localized changes in the color of the reference line 322, or a combination of both line segments, gaps, color changes, and other variations in the reference line for encoding information. The encoding pattern 324 may represent information regarding the image slice 404 such as the distance to the end 412 of the image slice 404 or other information about the image 400. The information may be transmitted to the controller 208 which may adjust one or more printing operations based on the information contained in the encoding pattern 324.

Step 606 of the method 600 may include sensing, using a reference line sensor 326 included with the printhead 300, the reference line 322 of an existing image slice 408 while printing the new image slice 406. As indicated above, a reference line sensor 326 may sense the reference line 322 of an existing image slice 408 and transmit a signal to the robot 202 and/or controller 208 causing the arm to adjust the printhead 300 such that the side edge 416 of the new image slice 406 is aligned with and/or is maintained in non-gapping and non-overlapping relation with the side edge 416 of the existing image slice 408.

Step 608 of the method 600 may include adjusting the lateral position of the new image slice 406 based on a sensed position of the reference line 322 to align a side edge 416 of the new image slice 406 with the side edge 416 of the existing image slice 408. In one example, the method may include detecting a misalignment of the side edge 416 of a new image slice 406 with the side edge 416 of an existing image slice 408 and providing real-time alignment feedback to the robot 202 and/or controller 208 for manipulating or adjusting the lateral position of the printhead 300 such that the side edge 416 of the new image slice 406 is aligned with the side edge 416 of the existing image slice 408. In this regard, the step of adjusting the lateral position of the new image slice 406 may include transmitting a signal from the reference line sensor 326 (e.g., an optical sensor) to the robot 202 and/or controller 208. The robot 202 and/or controller 208 may determine a correction input for the robot based on the misalignment of the printhead 300.

The method may include adjusting the position of the printhead 300 such that the side edge 416 of the new image slice 406 is maintained in non-gapped and non-overlapping relation with the side edge 416 of the existing image slice 408. In this regard, the lateral position of the printhead 300 may be physically adjusted to align the side edge 416 of the new image slice 406 with the side edge 416 of the existing image slice 408. Alternatively, the method may include electronically shifting the nozzles 308 that are actively ejecting droplets 330 to align the side edge 416 of the new image slice 406 with the side edge 416 of the existing image slice 408, as mentioned above.

The adjustment of the position and/or orientation of the printhead 300 may be facilitated using one or more high-bandwidth actuators 250 coupling the printhead 300 to an end 214 of an arm of the robot 202, as described above and illustrated in FIGS. 17-20. The high-bandwidth actuators 250 may adjust an orientation and/or position of the printhead 300 relative to the surface 102 during movement of the printhead 300 along the rastering path 350. The reference line sensor 326 may sense the reference line 322 and transmit a signal to the robot 202 for determining an adjustment to the lateral position of the printhead 300. The robot 202 and/or controller 208 may command the high-bandwidth actuators 250 to adjust the position of the printhead 300 such that the side edge 416 of the new image slice 406 is maintained in non-gapped relation with the side edge 416 of the existing image slice 408.

The method may include adjusting the printhead 300 by translating the printhead 300 along a transverse direction 354 parallel to the surface 102 and perpendicular to the rastering path 350, translating the printhead 300 along a normal direction 356 that is normal to the surface 102, and/or rotating the printhead 300 along a roll direction 358 about an axis parallel to the rastering path 350. Advantageously, the high-bandwidth actuators 250 may provide increased precision and rapid response time in adjusting the position and/or orientation of the printhead 300.

Additional modifications and improvements of the present disclosure may be apparent to those of ordinary skill in the art. Thus, the particular combination of parts described and illustrated herein is intended to represent only certain embodiments of the present disclosure and is not intended to serve as limitations of alternative embodiments or devices within the spirit and scope of the disclosure.

What is claimed is:

1. A system for printing an image on a surface, comprising:

a robot having at least one arm;

a printhead mounted to the arm and being movable by the arm over a surface along a new rastering path while printing a new image slice on the surface located immediately adjacent to and non-overlapping an existing image slice previously printed by the printhead moving over the surface along an existing rastering path;

a reference line printing mechanism included with the printhead and configured to print a reference line on the surface when printing the new image slice; and a reference line sensor configured to sense the reference line of the existing image slice previously printed along the existing rastering path and transmit a signal to the robot causing the arm to adjust the lateral position of the printhead moving along the new rastering path in a manner such that a side edge of the new image slice currently being printed along the new rastering path is aligned with the side edge of the existing image slice.

2. The system of claim 1, wherein:

the reference line printing mechanism comprises at least one nozzle of the printhead.

3. The system of claim 2, wherein:

the nozzle is located adjacent to a widthwise end of the printhead.

4. The system of claim 1, wherein:

the reference line sensor is an optical sensor configured to visually acquire the reference line and detect misalignment of the side edge of the new image slice with the side edge of the existing image slice and provide real-time alignment feedback to the robot for adjusting the lateral position of the printhead in a manner such that the side edge of the new image slice is maintained in alignment with the side edge of the existing image slice.

5. The system of claim 1, wherein:

the robot is configured to adjust the lateral position of the printhead such that the side edge of the new image slice is maintained in non-gapped and non-overlapping relation with the side edge of the existing image slice.

6. The system of claim 1, wherein:

the printhead is an inkjet printhead.

7. The system of claim 1, wherein the printhead is configured to print the reference line in at least one of the following formats:

visible within a visible spectrum;

fluroescent under fluorescent light;

invisible within the visible spectrum; and visible under ambient light and configured to fade over time under ambient conditions.

8. A system for printing an image on a surface, comprising:

a robot having at least one arm;

a printhead mounted to the arm and being movable by the arm over a surface along a rastering path while printing a new image slice on the surface;

at least one high-bandwidth actuator coupling the printhead to an end of the arm;

a reference line printing mechanism included with the printhead and configured to print a reference line on the surface when printing the new image slice;

a reference line sensor configured to sense the reference line of an existing image slice and transmit a signal to the robot causing the arm to adjust the printhead in a manner such that a side edge of the new image slice is aligned with the side edge of the existing image slice; and the high-bandwidth actuator configured to adjust at least one of an orientation and a position of the printhead relative to the surface during movement of the printhead along the rastering path.

9. The system of claim 8, wherein:

the high-bandwidth actuator is configured to adjust the printhead along at least one of the following directions:

a transverse direction of translation parallel to the surface and perpendicular to the rastering path;

a normal direction of translation normal to the surface; and a roll direction of rotation about an axis parallel to the rastering path.

10. The system of claim 9, wherein:

the high-bandwidth actuator includes a first actuator, a second actuator, and a third actuator arranged in an in-plane tripod configuration and each having an upper end and a lower end, the upper ends being pivotably coupled to an end of the arm of the robot, the lower ends being pivotably coupled to the printhead;

the upper ends of the first and third actuator being spaced apart from one another;

the lower ends of the first and third actuator being spaced apart from one another;

the upper end of the second actuator being located adjacent to the upper end of the first actuator;

the lower end of the second actuator being located adjacent to the lower end of the third actuator such that the second actuator extends diagonally between the upper end of the first actuator and the lower end of the third actuator; and the first, second, and third actuators enabling adjustment of the printhead along the transverse direction, the normal direction, and the roll direction.

11. A system for printing an image on a surface, comprising:

a robot having at least one arm;

an inkjet printhead mounted to the arm and being movable by the arm over a surface along a new rastering path while printing a new image slice on the surface located immediately adjacent to and non-overlapping an existing image slice previously printed by the printhead moving over the surface along an existing rastering path;

a reference line printing mechanism included with the inkjet printhead and configured to print a reference line on the surface when printing the new image slice; and a reference line sensor configured to sense the reference line of the existing image slice previously printed along the existing rastering path and transmit a signal to the robot causing the arm to adjust the lateral position of the inkjet printhead moving along the new rastering path in a manner such that a side edge of the new image slice currently being printed along the new rastering path is maintained in non-gapped and non-overlapping relation with the side edge of the existing image slice.

12. A method for printing an image on a surface, comprising:

printing, using a printhead mounted to an arm of a robot, a new image slice on the surface while moving the printhead over the surface along a new rastering path located immediately adjacent to and non-overlapping an existing image slice previously printed by the printhead moving over the surface along an existing rastering path;

printing a reference line on the surface when printing the new image slice;

sensing, using a reference line sensor, the reference line of the existing image slice while printing the new image slice; and adjusting, using a controller, the lateral position of the printhead based on a sensed position of the reference line in a manner aligning a side edge of the new image slice currently being printed along the new rastering path with the side edge of the existing image slice previously printed along the existing rastering path.

13. The method of claim 12, wherein the step of printing the reference line comprises:

printing the reference line using at least one nozzle of the printhead.

14. The method of claim 12, wherein the steps of sensing the reference line and adjusting the lateral position of the printhead comprise:

emitting, using an optical sensor, an optical beam toward the reference line;

generating, using the optical sensor, a signal representing a lateral location where the optical beam strikes the reference line;

transmitting the signal to the controller; and adjusting, using the controller, the lateral position of the printhead based on the signal such that the side edge of the new image slice is aligned with the side edge of the existing image slice.

15. The method of claim 12, wherein the step of adjusting the lateral position of the printhead includes:

transmitting from the reference line sensor to the robot a signal representative of the sensed position of the printhead relative to the reference line;

determining a correction input based on the sensed position of the printhead; and adjusting, based on the correction input, the lateral position of the printhead.

16. The method of claim 12, wherein the step of adjusting the lateral position of the printhead includes:

adjusting the lateral position of the printhead such that the side edge of the new image slice image slice is maintained in non-gapped and non-overlapping relation with the side edge of the existing image slice.

17. A method for printing an image on a surface, comprising:

printing, using a printhead having at least one high-bandwidth actuator coupling the printhead to an arm of a robot, a new image slice on the surface while moving the printhead over the surface along a rastering path, the printhead using at least one high-bandwidth actuator coupling the printhead to an end of the arm;

printing a reference line on the surface when printing the new image slice;

sensing, using a reference line sensor, the reference line of an existing image slice while printing the new image slice; and adjusting, using the at least one high-bandwidth actuator, the position of the printhead based on a sensed position of the reference line in a manner aligning a side edge of the new image slice with the side edge of the existing image slice.

18. The method of claim 17, wherein the step of adjusting the position of the printhead using the at least one high-bandwidth actuator includes at least one of the following:

translating the printhead along a transverse direction parallel to the surface and perpendicular to the rastering path;

translating the printhead along a normal direction normal to the surface; and rotating the printhead along a roll direction about an axis parallel to the rastering path.

* * * * *